US008007079B2

(12) United States Patent
Takahashi

(10) Patent No.: US 8,007,079 B2
(45) Date of Patent: Aug. 30, 2011

(54) LIQUID DROPLET JETTING HEAD AND METHOD OF MANUFACTURING LIQUID DROPLET JETTING HEAD

(75) Inventor: Yoshikazu Takahashi, Nagoya (JP)
(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 1099 days.
(21) Appl. No.: 11/710,835
(22) Filed: Feb. 26, 2007
(65) Prior Publication Data
US 2007/0206058 A1 Sep. 6, 2007
(30) Foreign Application Priority Data
Mar. 1, 2006 (JP) ..... 2006-054476
(51) Int. Cl.
*B41J 2/045* (2006.01)
(52) U.S. Cl. ..... 347/68
(58) Field of Classification Search ..... 347/68–72
See application file for complete search history.

(56) References Cited

U.S. PATENT DOCUMENTS
6,059,395 A * 5/2000 Takata et al. ..... 347/15
6,149,260 A 11/2000 Minakuti
FOREIGN PATENT DOCUMENTS
JP 10-202918 8/1998
JP 10315508 12/1998
* cited by examiner

*Primary Examiner* — An H Do
(74) *Attorney, Agent, or Firm* — Frommer Lawrence & Haug LLP

(57) ABSTRACT

A piezoelectric actuator, a cavity plate, a base plate, and a supply plate are common in normal specifications, black high-speed focused specifications, and color-image focused specifications, but other plates such as a manifold plate, a damper plate, a spacer plate, and a nozzle plate are produced according to these specifications. A center of a communicating hole which connects a pressure chamber and a nozzle is gradually shifted in a paper feeding direction, and a position at which the nozzle is formed is also shifted in the paper feeding direction. Accordingly, it is possible to decrease the number of manufacturing lines and to reduce the manufacturing cost as compared to those in a conventional method of manufacturing a liquid droplet jetting head.

14 Claims, 17 Drawing Sheets

NORMAL SPECIFICATIONS

NORMAL SPECIFICATIONS (ONE PASS 150 dpi)

P1=75dpi G1=150dpi

BLACK HIGH-SPEED FOCUSED SPECIFICATIONS

BLACK HIGH-SPEED FOCUSED SPECIFICATIONS
(FOR Bk, ONE PASS 300 dpi, FOR COLOR,
ONE PASS 75 dpi)

COLOR-IMAGE FOCUSED SPECIFICATIONS

COLOR-IMAGE FOCUSED SPECIFICATIONS
(FOR Bk, ONE PASS 150 dpi,
FOR COLOR ONE PASS 75 dpi)

Fig. 11A

| ACTIVE PORTION POSITION (COMMON ACCORDING TO ALL SPECIFICATIONS) | A | B | C | D | E | F | G | H |
|---|---|---|---|---|---|---|---|---|
| NORMAL SPECIFICATIONS | (3)Bk | (1)Bk | (3)Y | (1)Y | (3)C | (1)C | (3)M | (1)M |
| Bk HIGH-SPEED FOCUSED SPECIFICATIONS | (3)Bk | (1)Bk | (3)Bk | (1)Bk | (3)Y | (1)C | (3)M | (1)R |
| COLOR-IMAGE FOCUSED SPECIFICATIONS | (3)Bk | (1)Bk | (3)LC | (1)LM | (3)Y | (1)C | (3)M | (1)R |

Fig. 11B

| SHIFTING POSITION OF NOZZLE | A | B | C | D | E | F | G | H |
|---|---|---|---|---|---|---|---|---|
| NORMAL SPECIFICATIONS | (3)→(3) | (1)→(1) | (3)→(3) | (1)→(1) | (3)→(3) | (1)→(1) | (3)→(3) | (1)→(1) |
| Bk HIGH-SPEED FOCUSED SPECIFICATIONS | (3)→(4) | (1)→(2) | (3)→(3) | (1)→(1) | (3)→(2) | (1)→(2) | (3)→(2) | (1)→(2) |
| COLOR-IMAGE FOCUSED SPECIFICATIONS | (3)→(4) | (1)→(2) | (3)→(2) | (1)→(2) | (3)→(2) | (1)→(2) | (3)→(2) | (1)→(2) |

CONVENTIONAL NORMAL SPECIFICATIONS
A(Bk) LF POSITION (3)
B(Bk) LF POSITION (1)
C(Y) LF POSITION (3)
D(Y) LF POSITION (1)
E(C) LF POSITION (3)
F(C) LF POSITION (1)
G(M) LF POSITION (3)
H(M) LF POSITION (1)
XIIIB
XIIIB
30e
30f
30g
30h
32b
35a
31a
39a
31a
35b
39b
31b
31b
31b
39c
31c
31c
31c
39d
31d
31d
31d 39a
39a
P1
G1

(1)
(2)
(3)
(4)
G2
G2
G2
G1
P1
LF DIRECTION (SECONDARY SCANNING DIRECTION)
CR DIRECTION (MAIN SCANNING DIRECTION)

CONVENTIONAL BLACK HIGH-SPEED FOCUSED SPECIFICATIONS

CONVENTIONAL COLOR-IMAGE FOCUSED SPECIFICATIONS

Fig. 17A

| ACTIVE PORTION POSITION (MATCHING WITH NOZZLE POSITION) | A | B | C | D | E | F | G | H |
|---|---|---|---|---|---|---|---|---|
| NORMAL SPECIFICATIONS | (3)Bk | (1)Bk | (3)Y | (1)Y | (3)C | (1)C | (3)M | (1)M |
| Bk HIGH-SPEED FOCUSED SPECIFICATIONS | (4)Bk | (2)Bk | (3)Bk | (1)Bk | (2)Y | (2)C | (2)M | (2)R |
| COLOR-IMAGE FOCUSED SPECIFICATIONS | (4)Bk | (2)Bk | (2)LC | (2)LM | (2)Y | (2)C | (2)M | (2)R |

Fig. 17B

| EXAMPLE | Bk RECORDING | FULL COLOR RECORDING |
|---|---|---|
| NORMAL SPECIFICATIONS | AB | ABCDEFGH |
| Bk HIGH-SPEED FOCUSED SPECIFICATIONS | ABCD | BDEFGH |
| COLOR-IMAGE FOCUSED SPECIFICATIONS | AB | BCDEFGH |

LIQUID DROPLET JETTING HEAD AND METHOD OF MANUFACTURING LIQUID DROPLET JETTING HEAD

CROSS-REFERENCE TO RELATED APPLICATION

The present application claims priority from Japanese Patent Application No. 2006-054476, filed on Mar. 1, 2006, the disclosure of which is incorporated herein by reference in its entirely.

BACKGROUND OF THE INVENTION

1. Field of the Invention

The present invention relates to a liquid droplet jetting head which jets a liquid droplet from a nozzle connected to a pressure chamber, by applying selectively a jetting pressure by an actuator to the pressure chamber in which a liquid is accommodated, and a method of manufacturing the liquid droplet jetting head.

2. Description of the Related Art

An ink-jet recording apparatus which includes an ink-jet head which jets a liquid droplet of a color ink on to a recording medium while scanning the recording medium, and records a color image on the recording medium has been known (U.S. Pat. No. 6,149,260 (corresponds to Japanese Patent Application Laid-open No. H 10-202918)). An ink-jet head of an ink-jet recording apparatus has a plurality of specifications according to an application, such as general purpose specifications (hereinafter called as "normal specifications"), specifications focusing on a high-speed recording with a black ink (hereinafter called as "black high-speed focused specifications"), and specifications focusing on a high-quality recording with color inks (hereinafter called as "color-image focused specifications")

SUMMARY OF THE INVENTION

As it will be described later, generally, a pressure chamber in which the black ink is filled is longer than a pressure chamber in which an ink of other color (other color ink) is filled. Regarding the longer pressure chamber for the black ink, a piezoelectric actuator arranged above the pressure chamber for the black ink is required to be bigger than a piezoelectric actuator arranged above the pressure chamber for the other color ink. Moreover, an ink-jet head according to specifications for high speed with black ink has more pressure chambers for the black ink as compared to the pressure chambers in an ink-jet head according to the normal specifications. Furthermore, positions at which the nozzles are formed also change for each of the specifications. In other words, a structure of the cavity unit differs for each of the specifications. In this manner, in a method of manufacturing the conventional ink-jet head, since it is necessary to manufacture ink-jet heads having different sizes of the pressure chamber and the piezoelectric actuator, and/or different structures of the cavity unit, it involves a problem of an increase in the number of manufacturing lines and a high manufacturing cost.

An object of the present invention is to realize a liquid-droplet jetting head and a method of manufacturing the liquid-droplet jetting head in which, it is possible to decrease the number of manufacturing lines than the number of manufacturing lines in the conventional method, and to reduce the manufacturing cost.

According to a first aspect of the present invention, there is provided a method of manufacturing liquid droplet jetting heads which have a plurality of specifications, and each of which includes a cavity unit having a plurality of nozzles which jet a droplet of a liquid, a plurality of pressure chambers which accommodate the liquid, and a plurality of liquid channels which connect the nozzles and the pressure chambers respectively, and an actuator which selectively applies a jetting pressure to the liquid in the pressure chambers, including steps of a plates-providing step for providing a nozzle-plate group which includes a plurality of nozzle plates in which the nozzles are formed in different patterns; an intermediate-plate group which includes a plurality of intermediate plates in which the liquid channels are formed in a different pattern respectively; and a cavity plate in which the pressure chambers are formed;

a selecting step for selecting a nozzle plate among the nozzle-plate group which corresponds to a predetermined specification among the specifications and an intermediate plate among the intermediate-plate group which corresponds to the predetermined specification; and a stacking step for stacking the nozzle plate and the intermediate plate selected in the selecting step, and the cavity plate.

According to the first aspect of the present invention, it is possible to use commonly some of the plates, according to the plurality of types of specifications of the liquid droplet jetting heads with differing positions of nozzles, and to decrease the number of manufacturing lines and to reduce a manufacturing cost in proportion to an increase in the number of plates which can be used in common.

In the method of manufacturing the liquid droplet jetting head of the present invention, the intermediate plates may include a manifold plate in which the liquid channels and a common liquid chamber accommodating the liquid to be supplied to the pressure chambers are formed. The plates-providing step may further include providing a supply plate in which a plurality of throttles is formed, the throttles supplying the liquid from the common liquid chamber to the pressure chambers, having a channel resistance higher than a channel resistance of the pressure chambers, and connecting the common liquid chamber with the pressure chambers, when the supply plate is stacked into the cavity unit. The cavity plate and the supply plate may be commonly used for the specifications. The stacking step may further include stacking the supply plate.

In this case, since it is possible to use the plate in which the pressure chambers are formed (cavity plate), and the plate in which the apertures are formed (supply plate), commonly for the plurality of types of specifications, it is not necessary to manufacture the cavity plate and the supply plate in a separate manufacturing line for each specifications. Therefore, it is possible to decrease the number of manufacturing lines and to reduce the manufacturing cost accordingly. Moreover, since the cavity plate is common according to the plurality of specifications, it is possible to have an actuator which selectively applies pressure to the liquid in each pressure chamber, in common according to the plurality of types of specifications. Therefore, it is possible to decrease the number of manufacturing lines and to reduce the manufacturing cost accordingly. Particularly, since the actuator is a high-cost component even among structural components of the liquid droplet jetting head such as an ink-jet head, it is possible to reduce substantially the manufacturing cost as it is not necessary to manufacture a different actuator according to each of the specifications.

When the supply plate is manufactured in a different manufacturing line according to each specification, there is a possibility that a manufacturing error for each manufacturing line is reflected in the supply plate manufactured in each manufacturing line, which in turn may appear as a dimensional error generated according to each specification of the aperture. However, since the supply plate of each of the specifications is manufactured in the same manufacturing line, it is possible to make same the dimensional error in the aperture according to each specification. Consequently, it is possible to suppress a variation in a liquid droplet jetting characteristics which is caused due to a variation in a channel resistance of the aperture.

In the method of manufacturing the liquid droplet jetting head of the present invention, the throttles may be formed as grooves in the supply plate. The plates-providing step may further include providing a base plate which is common in the specifications and which has communicating holes formed therein, the common holes connecting the pressure chambers with the throttles respectively when the base plate is stacked between the cavity plate and the supply plate. The stacking step may further include stacking the base plate on the supply plate to cover openings of the throttles.

In this case, since it is possible to use commonly according to the plurality of specifications a plate in which the communicating hole is formed (base plate) in addition to the cavity plate and the supply plate, it is possible to manufacture the cavity plate, the supply plate, and the base plate in the same manufacturing line, irrespective of the type of the plurality of specifications. Therefore, it is possible to decrease the number of manufacturing lines and to reduce the manufacturing cost.

In the method of manufacturing the liquid droplet jetting head, the liquid channels, which are to be mutually communicated when the intermediate plates are stacked, may be formed in the intermediate plates. The stacking step may further include stacking each of the intermediate plates between the cavity plate and one of the nozzle plates such that the liquid channels are mutually communicated to thereby connect the pressure chambers and the nozzles respectively.

Since the second plates (intermediate plates) are stacked between the cavity plate and the nozzle plate, in a case of manufacturing an ink-jet head compliant with the plurality of types of specifications, since the cavity plate is common according to all specifications, there is no possibility that an error in a stacking position with respect to the intermediate plate in the pressure chamber formed in the cavity plate differs according to each of the specifications. Consequently, there is no possibility that a cycle in which (hereinafter called as "AL (acoustic length) value") the pressure wave generated in the pressure chamber is fluctuated by the pressure applied to the ink in the pressure chamber by the actuator, differs according to each of the plurality of specifications, and exerts an effect on the jetting characteristics of the liquid droplet.

In the method of manufacturing the liquid droplet jetting head of the present invention, the intermediate plates may include a manifold plate in which the liquid channels and the common liquid chamber which accommodates the liquid to be supplied to the pressure chambers may be formed.

In this case, it is possible to manufacture a manifold plate in which a position of a liquid channel differs corresponding to a nozzle plate in which a position of the nozzle differs according to each of the specifications, and to make the liquid channel formed in the manifold plate, and the nozzle communicate by stacking this structure as the intermediate plate.

In the method of manufacturing the liquid droplet jetting head of the present invention, the intermediate plates may include a manifold plate in which a common liquid chamber accommodating the liquid to be supplied to the pressure chambers is formed; and a damper plate which is to be stacked on the manifold plate and in which the liquid channels and a damper elastically deformable by a pressure vibration in the common liquid chamber are formed. The stacking step may further include stacking the damper plate between the manifold plate and one of the nozzle plates such that the damper faces the common liquid chamber.

In this case, it is possible to manufacture a plate in which the damper is formed (damper plate) in which a position of a liquid channel differs according to (corresponding to) the nozzle plate in which the position of the nozzle differs according to the specifications, and to make communicate the nozzle and the liquid channel formed in each of the manifold plate and the damper plate, by stacking this (structure) as the second plate (intermediate plate).

In the method of manufacturing the liquid droplet jetting head of the present invention, the intermediate plates may include a spacer plate in which the liquid channels are formed and the stacking step may further include stacking the spacer plate such that the spacer plate is adjacent to a surface, of one of the nozzle plates, on a side of the cavity plate.

In this case, it is possible to manufacture the spacer plate in which a position of a liquid channel differs corresponding to the nozzle plate in which the position of nozzle differs according to the specifications, and make communicate the nozzle and the liquid channel formed in each of the manifold plate, the damper plate, and the spacer plate, by stacking this structure as the intermediate plate.

In the method of manufacturing the liquid droplet jetting head according to the present invention, the liquid may be an ink, and the liquid droplet jetting head may be an ink-jet head which performs printing in a dot matrix manner by the ink jetted from the nozzles while moving in a predetermined direction with respect to the recording medium. The pressure chambers may be arranged in a matrix form, in the cavity plate in the predetermined direction and in an orthogonal direction orthogonal to the predetermined direction. The nozzles connecting to the pressure chambers respectively may be arranged in the matrix form, in each of the nozzle plates in the predetermined direction and in the orthogonal direction. The liquid channels may be arranged in the matrix form, in each of the intermediate plates in the predetermined direction and in the orthogonal direction. The plates-providing step may include providing the nozzle plates in which positions of the nozzles in the orthogonal direction are mutually different and the intermediate plates in which positions of the liquid channels are mutually different. The selecting step may include selecting one of the nozzle plates in which the nozzles are formed at positions corresponding to one of the specifications and one of the intermediate plates in which the liquid channels are formed at positions corresponding to the positions of the nozzles. The stacking step may include stacking the selected nozzle plate and intermediate plate.

In this case, since it is possible to use a part of the plurality of plates according to the plurality of types of specifications of the ink-jet head in which the position of the nozzle differs according to each of the specifications, it is possible to decrease the number of manufacturing lines and reduce the manufacturing cost in proportion to an increase in the plates which can be used commonly.

In the method of manufacturing the liquid droplet jetting head of the present invention, the pressure chambers may form a first pressure chamber group jetting a first liquid droplet and a second pressure chamber group jetting a second liquid droplet having a volume greater than a volume of the first liquid droplet, the first and second pressure chamber groups being arranged in the predetermined direction. The specifications may include a specification in which the first pressure chamber group accommodates a color ink, and the second pressure chamber group accommodates a black ink.

In this case, the ink-jet head performs recording by jetting the black ink and the color ink, and since it is possible to use some of the plurality of plates commonly for the plurality of specifications of the ink-jet head in which a volume of a liquid droplet of the black ink which can be jetted is more than a volume of a liquid droplet of the color ink which can be jetted, it is possible to decrease the number of manufacturing lines and to reduce the manufacturing cost in proportion to the increase in the plates which can be used commonly. For example, since a pigment-based ink has a property of hardly spreading on the recording medium such as a recording paper, in an ink-jet head which uses a pigment-based black ink and a dye-based color ink, it is necessary to make the volume of the droplet of the black ink jetted from the nozzle to be more than the volume of the droplet of the color ink. Even in such a case, it is possible to decrease the number of manufacturing lines of the ink-jet head and to reduce the manufacturing cost.

In the method of manufacturing the liquid droplet jetting head of the present invention, the specifications may include another specification in which a pressure chamber included in the second pressure chamber group accommodates the color ink.

In this case, it is possible to decrease the number of manufacturing lines and to reduce the manufacturing cost of an ink-jet head which jets a part of the color ink with a greater volume of liquid droplet similar to the black ink, in other words, an ink-jet head having specifications in which the significance is placed on the color-image quality.

According to a second aspect of the present invention, there is provided a liquid droplet jetting head which jets a droplet of a liquid including a cavity unit having a plurality of nozzles arranged in a predetermined surface; a plurality of pressure chambers which accommodate the liquid; and a plurality of liquid channels which connect the nozzles and the pressure chambers respectively, and which have portions extending in a vertical direction to the predetermined surface and other portions extending in a direction different from the vertical direction; and an actuator which is arranged on the cavity unit and which selectively applies a jetting pressure to the liquid in the pressure chambers.

According to the second aspect of the present invention, since the liquid channel is inclined with respect to a direction perpendicular to a direction of plane of a surface of the cavity unit in which the nozzles are formed (nozzle forming surface), it is possible to adjust a pitch of the nozzles while arranging the pressure chambers at an equal interval. Therefore, for achieving a desired resolution, it is possible to arrange the nozzles at an appropriate pitch.

According to the liquid droplet jetting head of the present invention, the liquid channels may include a first liquid channel extended in a first direction different from the vertical direction, and a second liquid channel extended in a second direction different from the vertical direction and the first direction. Since the liquid channels are extended in two directions which differ from the vertical direction, a degree of freedom of adjusting the pitch of the nozzles is improved while the interval between the pressure chambers is maintained, and it is possible to arrange the nozzles with the desired pitch.

According to the liquid droplet jetting head of the present invention, the cavity unit may include a first pressure chamber row and a second pressure chamber row arranged to be parallel to each other. Each of the first pressure chamber row and the second pressure chamber row may include a plurality of pressure chambers having an elongated shape, and which are arranged in a predetermined direction. A length of a pressure chamber included in the first pressure chamber row, in a longitudinal direction of the pressure chamber may be greater than a length of another pressure chamber included in the second pressure chamber row, in the longitudinal direction of the pressure chamber. In this case, it is possible to adjust independently a pitch of the nozzles communicating with long pressure chambers for a pigment-based black ink for example, and a pitch of the nozzles communicating with the pressure chambers for the inks of other colors.

In the liquid droplet jetting head of the present invention, a size of a nozzle, among the nozzles, connected to the pressure chamber in the first pressure chamber row may be greater than a size of another nozzle connected to the pressure chamber in the second pressure chamber row. In this case, since a diameter of the nozzle communicating with the long pressure chamber is longer, in a case in which the ink-jet head is used, while filling in the bigger pressure chamber with the pigment-based black ink which is expected to be consumed substantially, it is possible to discharge the black ink having less spreading (blotting) as a big droplet, and to improve the image quality.

BRIEF DESCRIPTION OF THE DRAWINGS

FIG. 11A is a table in which, positions of forming an active portion according to each of the specifications are put together;

FIG. 11B is a table in which, shifting positions according to the color-image focused specifications, and according to the black high-speed focused specifications with respect to normal specifications are put together;

FIG. 17A is a diagram showing a position of nozzle for each of the specifications; and FIG. 17B is a table showing combinations of nozzle rows used, according to a recording mode.

DETAILED DESCRIPTION OF THE PREFERRED EMBODIMENTS

Figure 1:
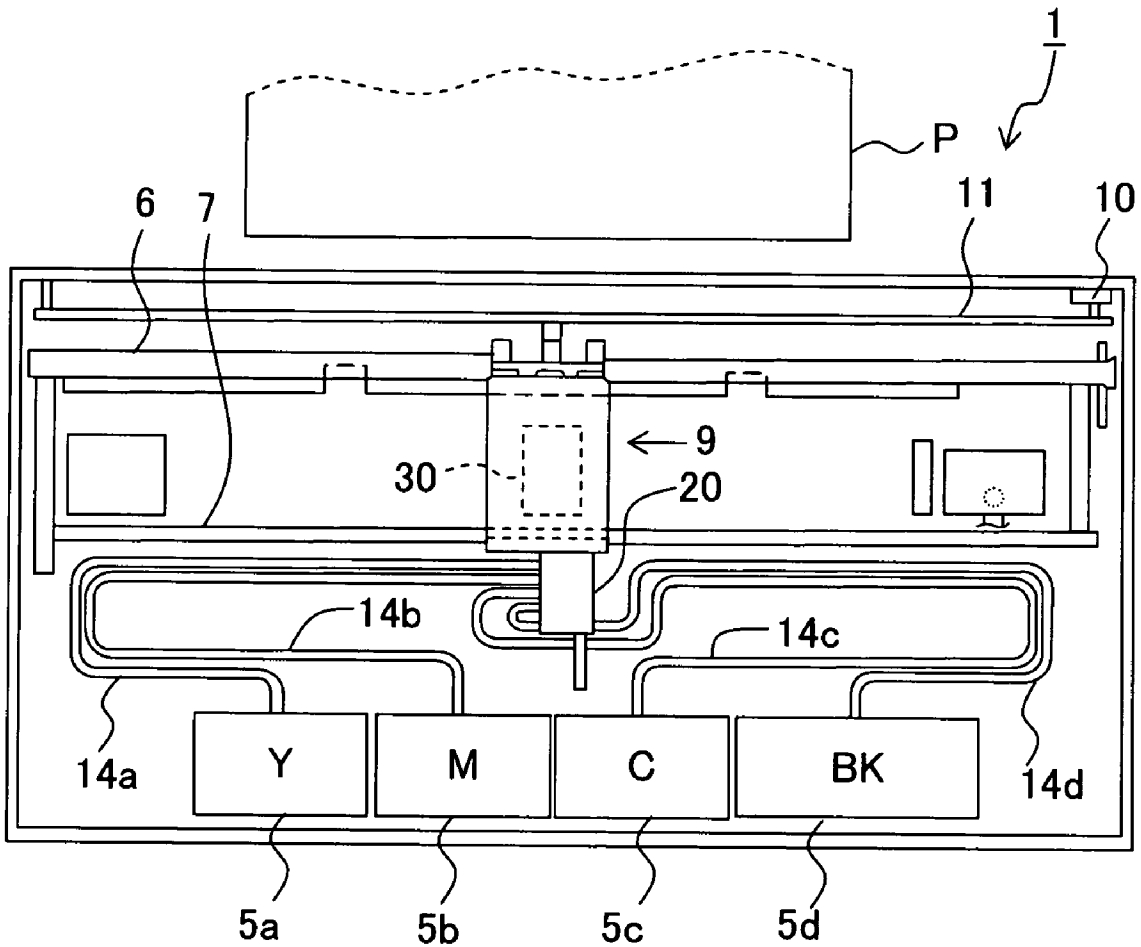
FIG. 1 is a plan view showing a basic structure of an ink-jet recording apparatus.

An embodiment of the present inventions will be described below with reference to the accompanying diagrams. Firstly, a basic structure of an ink-jet recording apparatus will be described with reference to FIG. 1. FIG. 1 is a plan view showing the basic structure of the ink-jet recording apparatus. An ink-jet recording apparatus 1 is provided with two guide shafts 6 and 7, and a head holder 9 functioning as a carriage, which is installed on these guide shafts 6 and 7. The head holder 9 holds an ink-jet head 30 which performs recording by jetting an ink on to a recording paper P. The head holder 9 is installed on an endless belt 11 which is rotated by a carriage motor 10, and is driven by the carriage motor 10 to move along the guide shafts 6 and 7.

The ink-jet recording apparatus 1 is provided with an ink tank 5*a* in which a yellow ink is accommodated, an ink tank 5*b* in which a magenta ink is accommodated, an ink tank 5*c* in which a cyan ink is accommodated, and an ink tank 5*d* in which a black ink is accommodated. The ink tanks 5*a* to 5*d* are connected to flexible ink supply tubes 14*a*, 14*b*, 14*c*, and 14*d* respectively. The ink supplied from each of the ink tanks 5*a* to 5*d*, through these ink supply tubes 14*a* to 14*d* is guided to an ink-jet head 30, via a tube joint which is extended in a frontward direction from the head holder 9. At this time, it is possible to use a pigment-based ink and/or a dye-based ink.

Next, before describing details of the present invention, a structure of an ink-jet head according to various specifications which was considered by the inventor of this application before the present invention is made. Here, the description will be made by giving an example of an ink-jet head which uses a pigment-based black ink and a dye-based color ink. Moreover, since a basic structure of a piezoelectric actuator and ink channels is common for each ink, here, the description will be made by giving an example of a structure of a portion jetting the black ink, of the ink-jet head.

Figure 14:
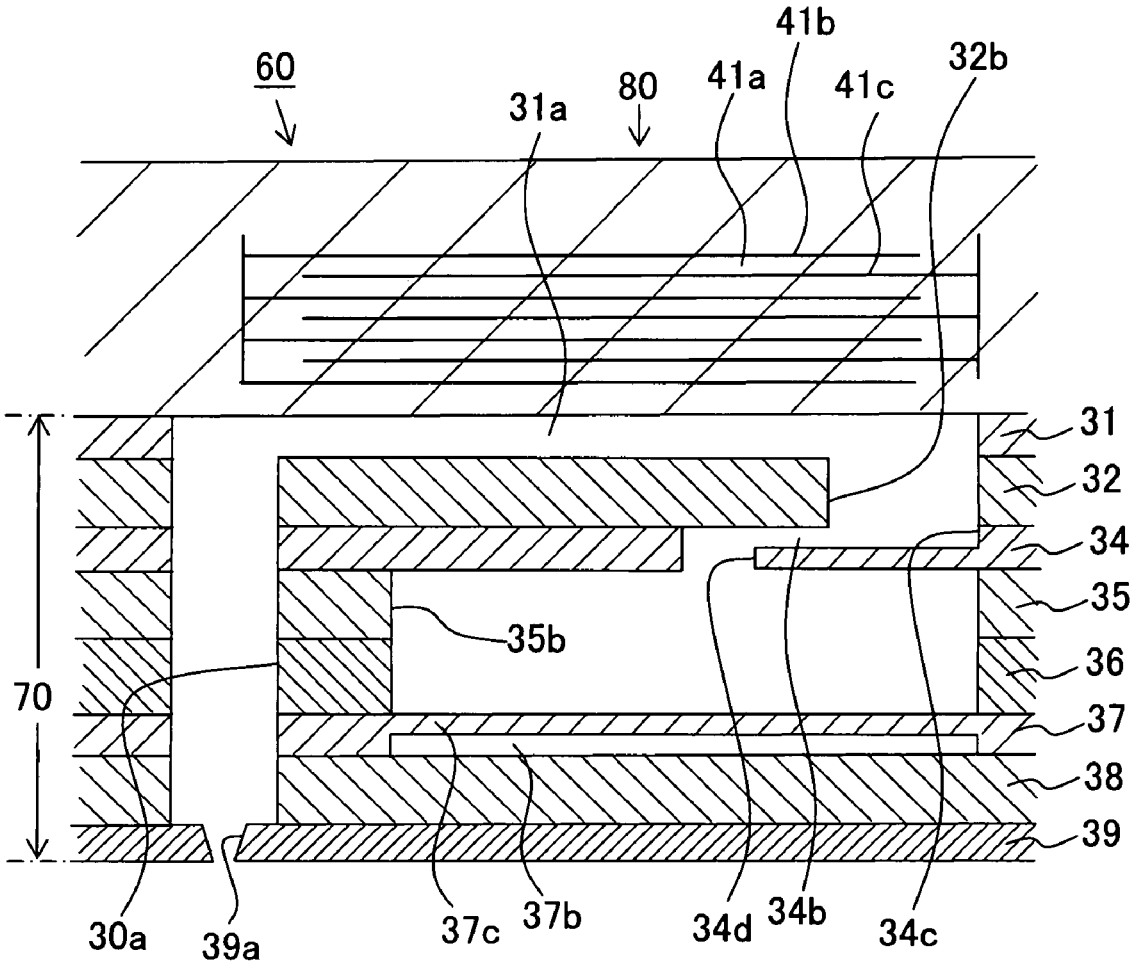
FIG. 14 is a vertical cross-sectional view of a portion from a piezoelectric actuator up to the nozzle, in a portion viewed from a direction of an arrow X-X in FIG. 12A.

As shown in FIG. 14, an ink-jet head 60 includes a cavity unit 70 and a piezoelectric actuator 80 connected to an upper surface of the cavity unit 70. The cavity unit 70 includes a nozzle plate 39, a spacer plate 38, a damper plate 37, manifold plates 36 and 35, a supply plate 34, a base plate 32, and a cavity plate 31, and these plates are stacked in an order from bottom to top. The piezoelectric actuator 80 includes a plurality of piezoelectric sheets 41*a* formed of a piezoelectric material, and electrodes 41*b* and 41*c* in the form of a film. The piezoelectric sheets 41*a*, and the electrodes 41*b* and 41*c* are stacked in a state in which the electrode 41*b* and 41*c* arranged alternately between the piezoelectric sheets 41*a*.

Figures 13A, 13B, 13C:
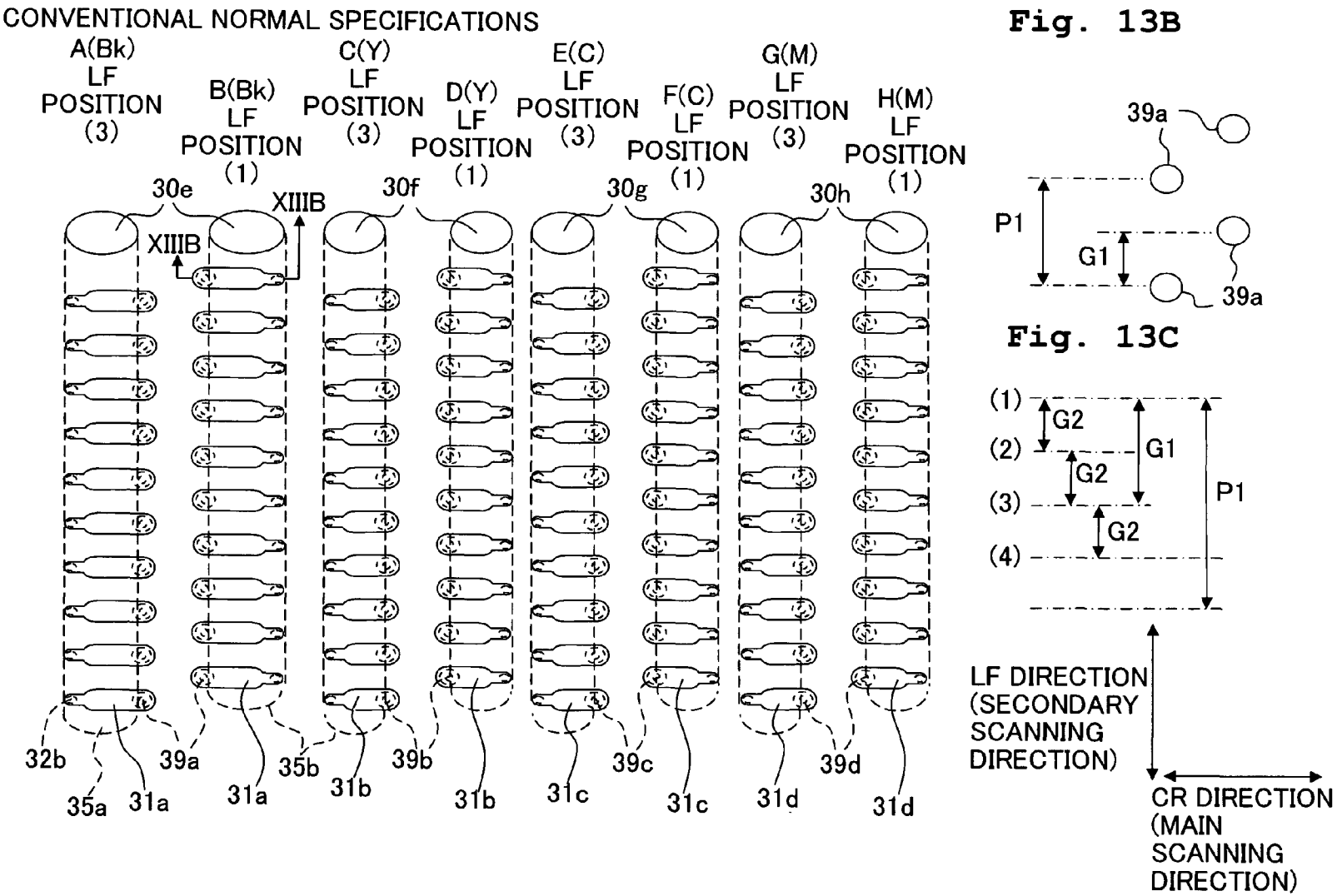
FIG. 13A is a diagram showing an arrangement of pressure chambers and nozzles of the normal specifications.
FIG. 13B is a diagram showing a pitch and a gap between the nozzles.
FIG. 13C is a diagram showing a direction for explaining a position of forming of the nozzle.

As shown in FIG. 13A, eight pressure chamber rows (rows A to H; pressure chamber groups) are formed in the cavity plate 31, and each pressure chamber row includes a plurality of pressure chambers. Pressure chambers 31 included in the pressure chamber row A, and the pressure chamber row B are allocated as pressure chambers 31*a* which accommodate the black ink. As shown in FIG. 14, a plurality of pressure chambers 31*a* accommodating the black ink is formed in the cavity plate 31. The pressure chambers 31*a* are formed as grooves opening on an upper surface of the cavity plate 31. A common ink chamber 35*b* which accommodates the black ink to be supplied to the pressure chambers 31*a* is formed in the manifold plates 36 and 35. An aperture 34*b* (a throttle 34*b*) is formed in the supply plate 34. The aperture 34*b* communicates with the common ink chamber 35*b* via a communicating hole 34*d* which is penetrated through the supply plate 34. A communicating hole 32*b* which communicate the pressure chamber 31*a* with one end 34*c* of the aperture 34*b*, is formed to penetrate through the base plate 31*a*. In other words, the pressure chamber 31*a* is connected to the common ink chamber 35*b* via the aperture 34*b* and the communicating hole 34*d*.

A channel resistance of the aperture 34*b* is higher than a channel resistance of the common ink chamber 35*b* and a channel resistance of the pressure chamber 31*a*. Therefore, when a pressure is applied by the piezoelectric actuator 80 to the black ink in the pressure chamber 31*a*, it is possible to generate efficiently a flow of the black ink toward a nozzle 39*a*. Moreover, since a flow of the black ink toward the common ink chamber 35*b* is suppressed, it is possible to record at a high speed with a favorable jetting efficiency.

A damper chamber 37*b* is formed in the damper plate 37. The damper plate 37 is formed of a material such as a metal which is elastically deformable. A bottom-plate-portion 37*c* in a form of a thin plate, at an upper portion of the damper chamber 37*b*, is capable of vibrating freely toward the common ink chamber 35*b* and also toward the damper chamber 37*b*. At the time of ink jetting, when a pressure fluctuation generated in the pressure chamber 31*a* is propagated to the common ink chamber 35*b*, the pressure fluctuation is absorbed and attenuated due to vibrations caused by an elastic deformation of the bottom-plate-portion 37*c* (a damper effect). Accordingly, it is possible to prevent a cross-talk in which the pressure fluctuation is propagated to another pressure chamber.

Communicating holes having a same diameter of an opening, and communicating mutually in a vertical direction are formed in the plates 32 to 38 arranged between the cavity plate 31 and the nozzle plate 39. Ink channels for guiding the black ink in the pressure chamber 31*a* to the nozzle 39*a* are formed by these communicating holes. Hereinafter, an ink channel formed by each communicating hole in the cavity plate 31 to the spacer plate 38 will be called as a "descender". A descender 30 which penetrate through the plates 32 to 38 in a vertical direction is formed between the pressure chamber 31*a* and the nozzle 39*a* jetting the black ink in the pressure chamber 31*a*.

FIG. 13C is a diagram showing a direction for describing a position of formation of a nozzle, and LF1, LF2, LF3, and LF4 (LF1 to LF4) shown in FIG. 13C correspond to LF positions (LF1 to LF4) shown in FIG. 13A, respectively. Hereinafter, a traveling direction of a carriage 9 on which the ink-jet head 60 is mounted, that is, a direction of recording lines of the ink-jet head 60 with respect to a recording medium will be called as a CR direction (main scanning direction), and a direction orthogonal to the CR direction will be called as an LF direction (paper feeding direction, secondary scanning direction). As shown in FIG. 13A, when the cavity plate 31 is viewed from an upper side (plan view), a plurality of pressure chambers 31*a* to 31*d* is arranged in a matrix form in the cavity plate 31. As it has been described earlier, the eight pressure chamber rows (pressure chamber row A to pressure chamber row H) arranged in the main scanning direction are disposed in the cavity plate 31, and each of the pressure chamber rows includes a plurality of pressure chambers lined up in the secondary scanning direction. However, the number of pressure chambers in each of the pressure chamber rows shown in FIG. 13A is less than the actual number of pressure chambers, and 10 pressure chambers are exemplified in each of the pressure chamber rows.

The pressure chambers 31*a* in the pressure chamber rows A and B accommodate the pigment-based black ink which is supplied from ink supply ports 30*e* through the common ink chamber 35*b*. The pressure chambers 31*b* in the pressure chamber rows C and D accommodate a dye-based yellow ink which is supplied,, from ink supply ports 30*f*. The pressure chambers 31*c* in the pressure chamber rows E and F accommodate a dye-based cyan ink which is supplied from ink supply ports 30*g*. The pressure chambers 31*d* in the pressure chamber rows G and H accommodate a dye-based magenta ink which is supplied from ink supply ports 30*h*.

A length of the pressure chamber in a direction of a flow of ink (a length of the pressure chamber in a direction connecting the communicating hole 32*b* and the descender 30*a*) is defined as a pressure chamber length, and a length of the pressure chamber in a direction orthogonal to a direction of the flow of ink is defined as a pressure chamber width. The width of each pressure chamber is the same but the pressure chamber length of the pressure chambers 31*a* (pressure chamber rows A and B) which accommodate the black ink is longer than the pressure chamber length of the pressure chambers 31*b* to 31*d* (pressure chamber rows C to H) which accommodate the other color inks. Moreover, a size of the piezoelectric actuator arranged above the pressure chamber 31*a* which accommodate the black ink is bigger than a size of the piezoelectric actuator which is arranged above the pressure chambers 31*b* to 31*d* which accommodate the other color inks. Furthermore, a diameter of the nozzle 39*a* which jets the black ink is larger than a diameter of other nozzles 39*b* to 39*d* which jet the other color inks. Since the pigment-based ink hardly bleed on the recording paper in comparison with the dye-based ink, an area of one dot which is formed by the pigment-based ink becomes smaller than an area of one dot which is formed by the dye-based ink in the same volume as the pigment-based ink. A diameter of the nozzles, the piezoelectric actuators, and the pressure chambers for the pigment-based black ink are formed more greatly than those for the dye-based ink so as to increase a volume of a droplet of the pigment-based black ink. Accordingly, the area of one dot formed by the pigment-based ink can be substantially same as the area of one dot formed by the dye-based ink.

The nozzles in the two nozzle rows formed corresponding to the two pressure chamber rows which accommodate the ink of same color are arranged in a zigzag form. FIG. 13B is a diagram showing the pitch of the nozzles. The pitch of the nozzles (nozzle interval) in the secondary scanning direction is set in accordance with a resolution which is set according to specifications of an ink-jet recording apparatus. For example, when the resolution is 150 dpi, a pitch P1 between the nozzles in each nozzle row is 339 μm (corresponds to 75 dpi), and a nozzle interval G1 (=P1/2) between the two nozzles in each of the adjacent rows of nozzles is 169 μm (corresponds to 150 dpi). The nozzle row is arranged in the CR direction, and the nozzles in the nozzle row of each color are arranged at the LF positions (LF1) and (LF3) in FIG. 13C. When the ink-jet head 60 performs recording in one way in the main scanning direction (CR direction) on the recording medium, an image or the like is recorded in the LF direction on the recording medium with a resolution of 150 dpi. At the time of recording an image with a resolution of 300 dpi which is same as according to the black high-speed focused specifications which will be described later, the image is recorded at the LF positions (LF2) and (LF4) shown in FIG. 13C, while moving the ink-jet head 60 by G2 (=P1/4) in the LF direction with respect to the recording paper.

FIG. 17B shows combinations of nozzle rows to be used in accordance with a recording mode. Hereinafter, a recording mode in which the recording is performed only with the black ink will be called as a black recording (Bk recording) mode, and a recording mode in which the recording is performed with the black ink and the color ink will be called as a full-color recording mode. In a case of recording with the black recording mode by using the ink-jet head according to the normal specifications, only the pressure chambers in the pressure chamber rows A and B are used, and in a case of recording with the full-color recording mode, the pressure chambers in the pressure chamber rows A to H are used.

Figure 15:
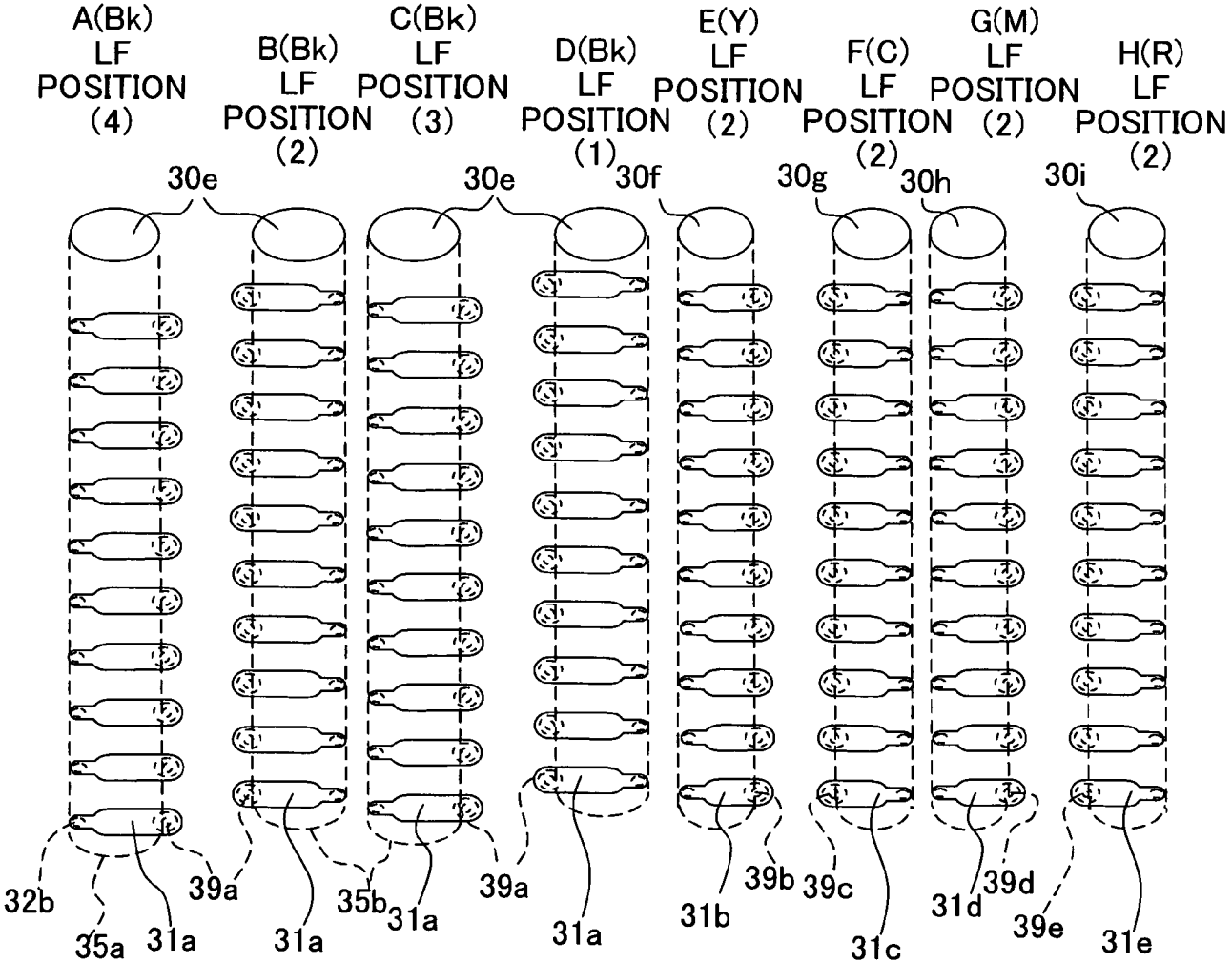
FIG. 15 is a diagram showing an arrangement of pressure chambers and nozzles according to conventional black high-speed focused specifications.

FIG. 15 shows an arrangement of pressure chambers and nozzles in the ink-jet head according to the black high-speed focused specifications which, the inventors of the present invention had considered before the invention in the present patent application. Eight pressure chamber rows (pressure chamber rows A to H) are formed in a cavity plate in the ink-jet head according to the black high-speed focused specifications, and out of these eight pressure chamber rows, the four pressure chamber rows (pressure chamber rows A to D) include the pressure chambers 31*a* which accommodate the pigment-based black ink. The pressure chamber row E includes the pressure chambers 31*b* which accommodate the yellow ink, the pressure chamber row F includes the pressure chambers 31*c* which accommodate the cyan ink, and the pressure chamber row G includes the pressure chambers 31*d* which accommodate the magenta ink. The pressure chamber row H includes the pressure chambers 31*e* which accommodate a red ink. The red ink which is accommodated in the pressure chambers 31*e* is supplied from an ink supply port 30*i*. The pressure chamber 31*a* in the pressure chamber rows C and D are longer than the pressure chambers 31*b* to 31*e* which accommodate the other dye-based inks, similarly as the pressure chambers 31*a* in the pressure chamber rows A and B. Moreover, the piezoelectric actuators and the nozzles 39*a* corresponding to the pressure chambers 31*a* in the pressure chamber rows A to D are bigger than the piezoelectric actuators and the nozzles 39*b* to 39*e* corresponding to the pressure chambers 31*b* to 31*e* in the pressure chamber rows E to H.

In the ink-jet head according to the black high-speed focused specifications, the nozzles 39*a* for the black ink are arranged at the LF positions LF1 to LF4 in FIG. 17, and the nozzles 39*b*, 39*c*, and 39*d* for the other color inks are at the LF position LF2. The nozzle pitch is same as the nozzle pitch in the ink-jet head according to the normal specifications described above. When one-way recording is performed in the CR direction, image with a resolution of 300 dpi is recorded in the LF direction with the black ink. The resolution of the image is 75 dpi when the recording is performed with the color ink. Moreover, as shown in FIG. 17B, in a case of recording in the black recording mode by using the ink-jet head according to the black high-speed focused specifications, only the pressure chamber rows A to D are used, and in a case of recording in the full-color recording mode, the pressure chamber rows B, D, E, F, G, and H are used.

Figure 16:
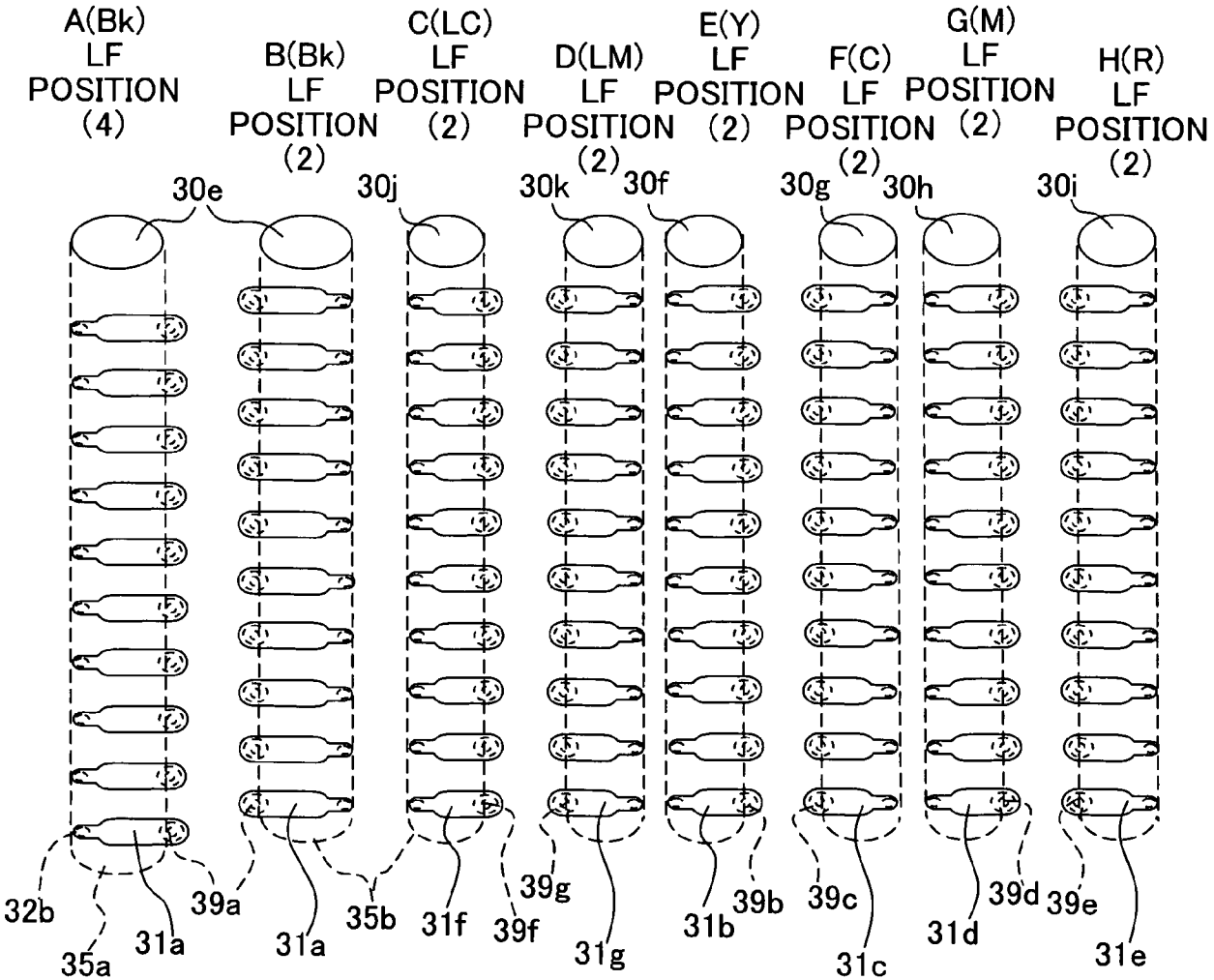
FIG. 16 is a diagram showing an arrangement of pressure chambers and nozzles according to conventional color-image focused specifications.

FIG. 16 is diagram showing an arrangement of pressure chambers and nozzles in an ink-jet head according to color image focused specifications (specifications when the significance is placed on the color-image quality) which the inventor of the present invention had considered before the invention in the present patent application. In a cavity plate of the ink-jet head according to the color image focused specifications, the pressure chamber rows A and B include the pressure chambers 31*a* which accommodate the pigment-based black ink. The pressure chamber row C includes the pressure chambers 31*f* which accommodate a light cyan ink, the pressure chamber row D includes the pressure chambers 31*g* which accommodate a light magenta ink, the pressure chamber row E includes the pressure chambers 31*b* which accommodate the yellow ink, the pressure chamber row F includes the pressure chambers 31*c* which accommodate the cyan ink, the pressure chamber row G includes the pressure chambers 31*d* which accommodate the magenta ink, and the pressure chamber row H includes the pressure chambers 31*e* which accommodate the red color ink. The light cyan ink accommodated in the pressure chambers 31*f* in the pressure chamber row C is supplied from an ink supply port 30*j*, and the light magenta ink accommodated in the pressure chambers 31*g* in the pressure chamber row D is supplied from an ink supply port 30*k*. The pressure chamber 31*a* in the pressure chamber rows A and B is longer than the pressure chambers 31*b* to 31*g* which accommodate the dye-based inks of other colors, similarly as in the case of the ink-jet head according to the normal specifications. Moreover, the piezoelectric actuators and the nozzles 39*a* corresponding to the pressure chambers 31*a* in the pressure chamber rows A and B are bigger than the piezoelectric actuators and the nozzles 39*b* to 39*g* corresponding to the pressure chambers 31*b* to 31*g* in the pressure chamber rows C to H.

In other words, in the ink-jet head according to the specifications in which the significance is placed on the color-image quality, it is possible to use the light cyan ink, the light magenta ink, and the red ink in addition to the yellow ink, the cyan ink, and the magenta ink used in the ink-jet head according to the normal specifications, and by placing significance on the color image quality, it is possible to perform a high image quality recording. Moreover, the nozzles included in the nozzle rows A and B which jet the black ink are arranged in a zigzag form, and a shift in the pitch between the adjacent nozzles is ½. However, in the nozzle rows C and H which jet the color ink, there is no shift in the pitch between the adjacent nozzles. As shown in FIG. 17B, in a case of recording in the black recording mode according to the color-image focused specifications, only the nozzle rows A and B are used, and in a case of recording in the full-color recording mode, the nozzle rows B to H are used.

Next, a structure of an ink-jet head 30 according to an embodiment of the present invention will be described with reference to FIG. 2 to FIG. 4B. In the following description, a direction in which the ink is jetted is let to be a downward direction. Moreover, in this embodiment, a cross-sectional structure of a pressure chamber in a longitudinal direction is basically same as a cross-sectional structure of a conventional ink-jet head 60 shown in FIG. 14. Same reference numerals are used for same components, and description of such components is either simplified or omitted.

Figure 2:
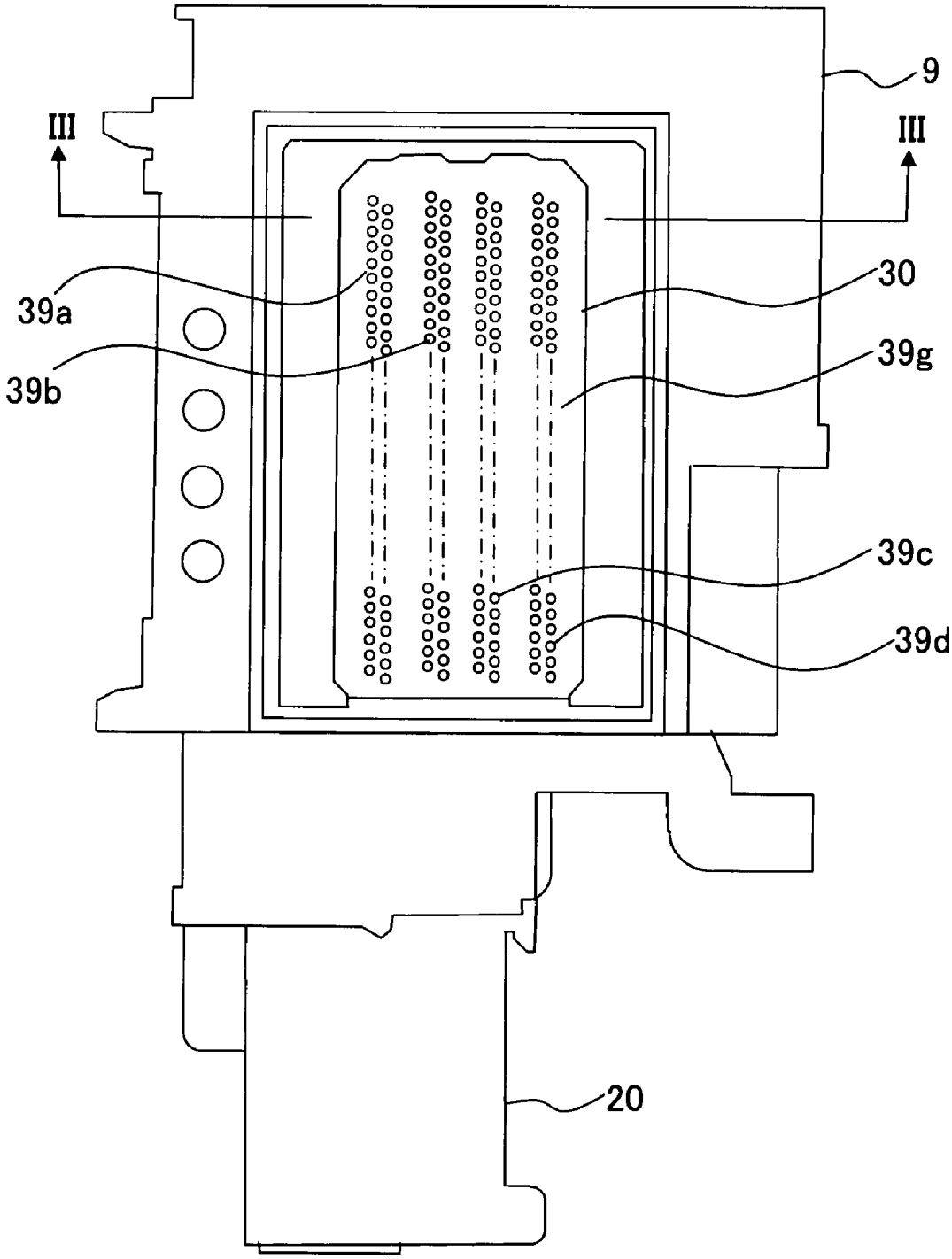
FIG. 2 is a plan view of a head holder 9 when viewed from a nozzle surface

As shown in FIG. 2, the nozzles 39*a* which jet the black ink, the nozzles 39*b* which jet the yellow ink, the nozzles 39*c* which jet the cyan ink, and the nozzles 39*d* which jet the magenta ink are arranged in a nozzle surface 39*g* formed on a lower surface of the ink-jet head 30. For each color, two nozzle rows extended in a direction orthogonal to a direction of movement (a direction orthogonal to a main scanning direction; sub-scanning direction) of a head holder 9 are formed. Each nozzle has an opening which opens downward, and faces an upper surface of the recording medium such as recording paper P (refer to FIG. 1).

Figure 3:
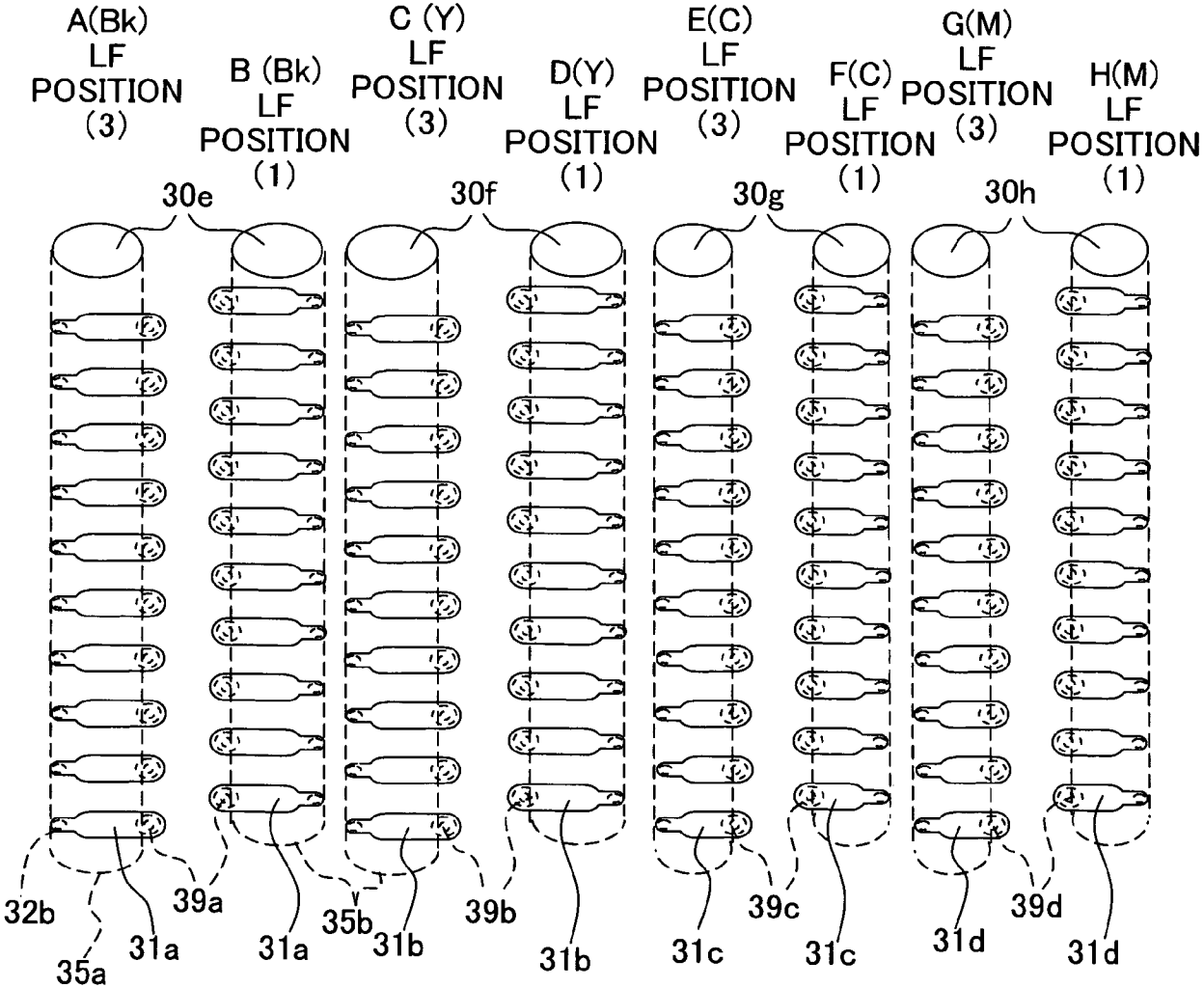
FIG. 3 is a diagram showing an arrangement of pressure chambers and nozzles according to normal specifications, in an ink-jet head held by the head holder 9 shown in FIG. 2.
Figure 4A:
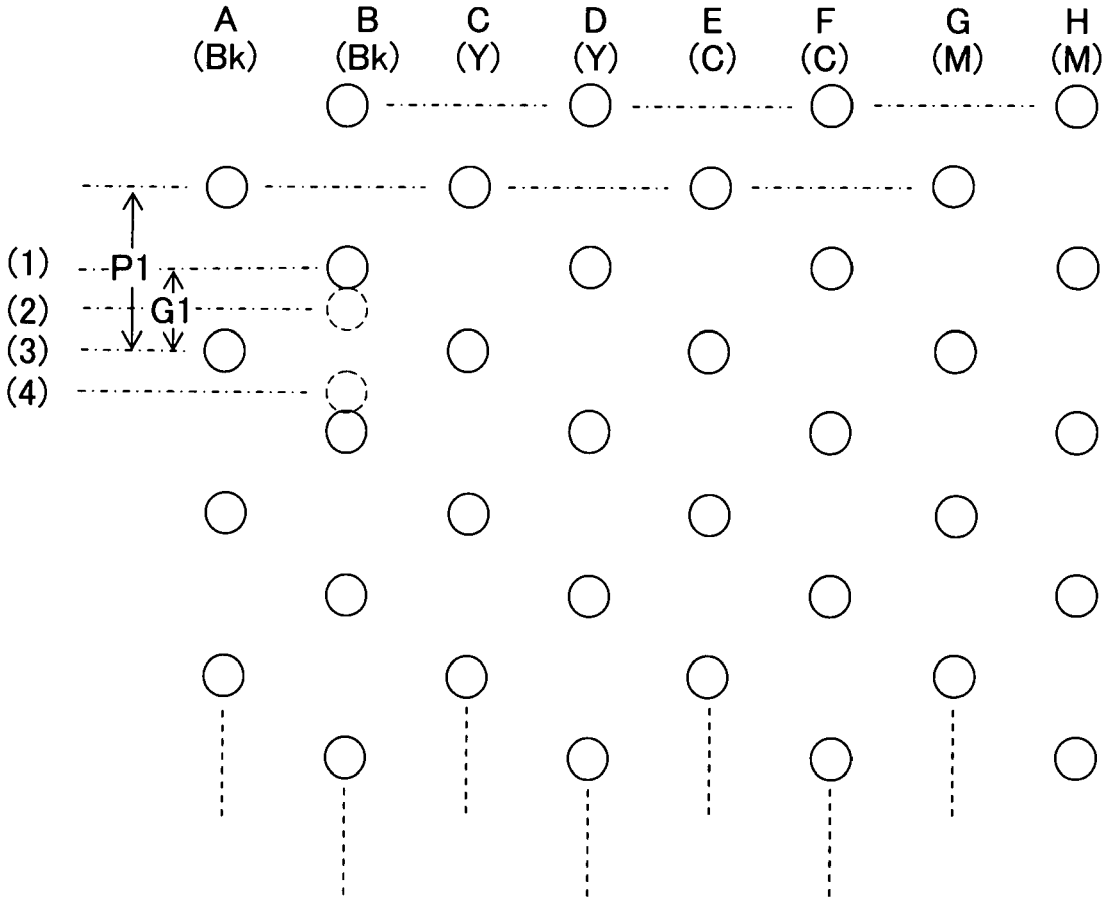
FIG. 4A is a diagram showing an arrangement of nozzles shown in FIG. 3.

As shown in FIG. 3, in the ink-jet head 30 according to the normal specifications, the pressure chamber rows A and B are used for jetting the pigment-based black ink, the pressure chamber rows C and D are used for jetting the pigment-based yellow ink, the pressure chamber rows E and F are used for jetting the dye-based cyan ink, and the pressure chamber rows G and H are used for jetting the dye-based magenta ink. As shown in FIG. 4A, a nozzle pitch P1 in each nozzle row is 75 dpi, and a nozzle interval G1 (=P1/2) between the rows of the same color is 150 dpi. In other words, in this embodiment, a resolution of an image which can be recorded in one pass, that is, a resolution of an image which can be recorded by one-way drive of the ink-jet head is 150 dpi.

It is possible express a nozzle position with respect to the LF direction (hereinafter called as "LF position") by using the LF1 to LF4 which are set at 300 dpi (G2). As shown in FIG. 3, all LF positions of the nozzles in the nozzle rows B, D, F, and H are LF1. Moreover, the LF positions of the nozzles in the nozzle rows A, C, E, and G are all LF3. In other words, it is possible to classify the nozzle rows jetting the ink droplets of the black ink, the yellow ink, the cyan ink, and the magenta ink into a group of nozzle rows jetting with LF1, and a group of nozzle rows jetting with LF2.

The pressure chamber 31*a* which accommodates the black ink, and the pressure chamber 31*b* which accommodates the yellow ink are longer than the pressure chambers 31*c* and 31*d* which accommodate the other inks. Moreover, it is not shown in the diagram, but regarding a size of a portion of a piezoelectric actuator which is arranged above the pressure chamber, which acts for applying a pressure for jetting the ink in the pressure chamber (portion in which, electrodes 41*b* and 41*c* are overlapped in a plan view. Hereinafter called as "active portion"), the size of an active portion 41 (FIG. 5B) corresponding to the pressure chambers 31*a* and 31*b* is bigger than a size of an active portion corresponding to the pressure chambers 31*c* and 31*d*. For example, regarding the length of the pressure chamber, the length of the pressure chamber in the pressure chamber rows A, B, C, and D is 1.42 mm and the length of the pressure chamber in the pressure chamber rows E, F, G, and H is 1.12 mm. Furthermore, a diameter of the nozzle in the pressure chamber rows A, B, C, and D is 20 μm and a diameter of the nozzle in the pressure chamber rows E, F, G, and H is 17 μm.

Since the pigment-based ink has a property of hardly spreading on the recording paper P, an area per dot when discharged onto the recording paper P becomes smaller than an area per dot of the dye ink. Therefore, by forming the pressure chambers and the active portion for jetting the pigment-based black ink and the pigment-based yellow ink to be bigger than the pressure chambers and the active portion for jetting the dye-based cyan ink and the dye-based magenta ink, a maximum volume of the a droplet of the pigment-based black ink and the pigment-based yellow ink which can be jetted from the nozzles 39*a* and 39*b* is let to be more than a maximum volume of the dye-based ink jetted from the nozzles 39*a* and 39*b*. Or, since the yellow ink is not highly visible, a droplet of the yellow ink may be let to be bigger than a droplet of the other ink by using a dye-based ink.

Figure 5A:
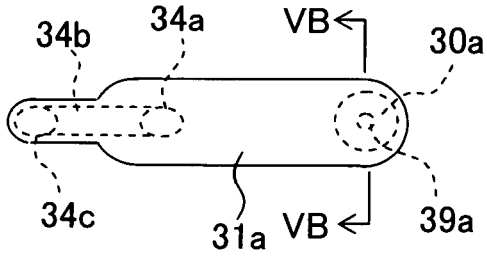
FIG. 5A is an enlarged view of the pressure chamber and the nozzle shown in FIG. 3.
Figure 5B:
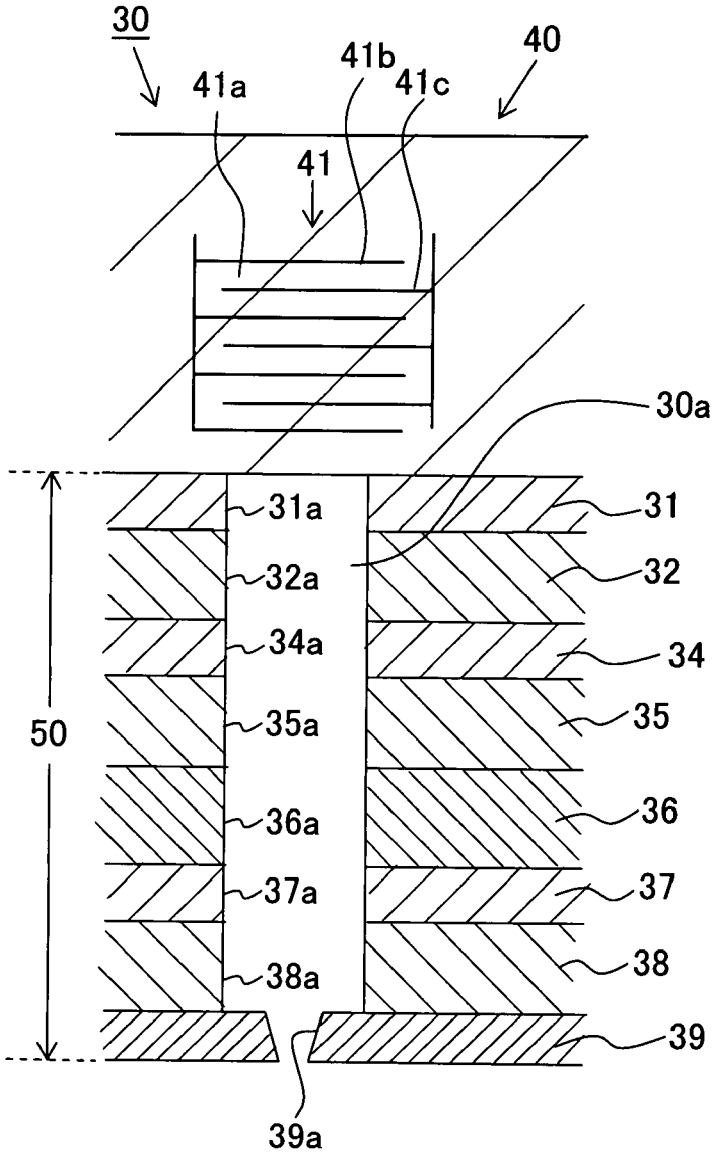
FIG. 5B is a vertical cross-sectional view of a portion from a piezoelectric actuator up to the nozzle, in a portion viewed from a direction of an arrow VB-VB in FIG. 5A.

As shown in FIG. 5B and FIG. 14, the ink-jet head 30 includes a piezoelectric actuator 40 which is joined to an upper surface of a cavity unit 50. As it has been mentioned above, the cavity unit 50 is a structure which is formed by stacking total of eight thin plates namely the nozzle plate 39, the spacer plate 38, the damper plate 37, the manifold plates 36 and 35, the supply plate 34, the base plate 32, and the cavity plate 31 in an order from the bottom to top. A material such as an adhesive can be used for joining each plate to the other plate, and the cavity unit 50 to the piezoelectric actuator 40.

The descender 30*a* which is formed in the cavity unit 50 is formed by communicating holes 32*a*, 34*a*, 35*a*, 36*a*, 37*a*, and 38*a* formed in the base plate 32, the supply plate 34, the manifold plates 35 and 36, the damper plate 37, and the spacer plate 38 respectively. The descender 30*a* is formed to be perpendicular from the communicating hole 32*a* which is formed in the based plate 32, and which communicates with the pressure chamber 31*a*, up to the communicating hole 38*a* which is formed in the spacer plate 38. A center of the descender 30*a* in a radial direction coincides with a center of the nozzle 39*a* in a radial direction.

Next, an arrangement of the pressure chambers and the nozzles of the ink-jet head according to the black high-speed focused specifications (black high-speed specification) will be described below.

Figure 6:
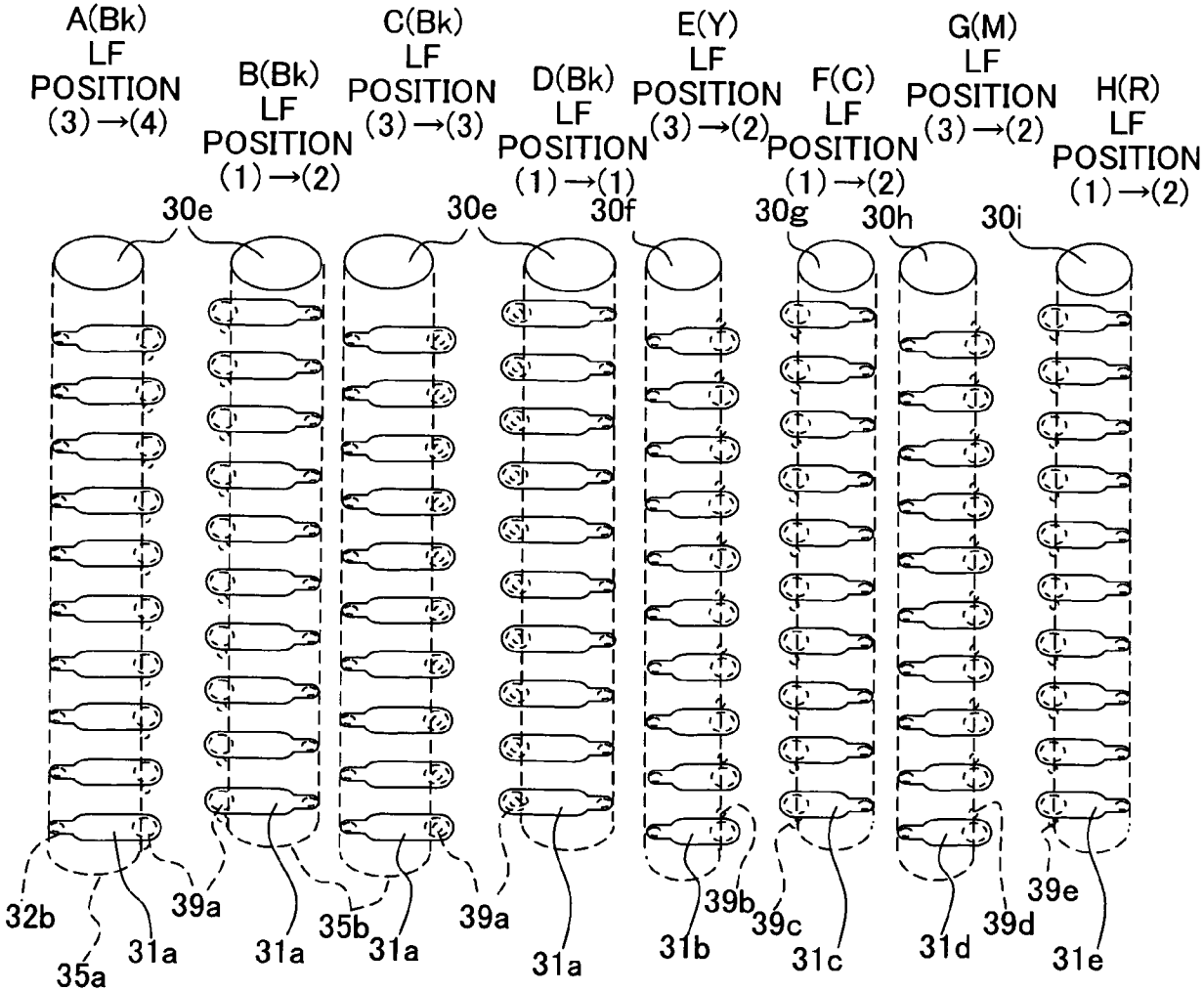
FIG. 6 is a diagram showing an arrangement of pressure chambers and nozzles of an ink-jet head according to black high-speed specifications.

As shown in FIG. 6, in the ink-jet head 30 according to the black high-speed focused specifications the pressure chambers in the pressure chamber rows A to D are used for jetting the pigment-based black ink, the pressure chambers in the pressure chamber rowE are used for jetting the dye-based yellow ink, the pressure chambers in the pressure chamber row F are used for jetting the dye-based cyan ink, the pressure chambers in the pressure chamber row G are used for jetting the dye-based magenta ink, and the pressure chambers in the pressure chamber row H are used for jetting the dye red ink. The arrangement and the size of each piezoelectric actuator and the pressure chamber corresponding to the pressure chambers in the pressure chamber rows A to H are the same as in a case of the ink-jet head according to the normal specifications. FIG. 11A is a table showing positions of forming an active portion for each specifications. As shown in FIG. 11A, positions for forming the active portion in each row according to each of the specifications are the same respectively.

Figure 4B:
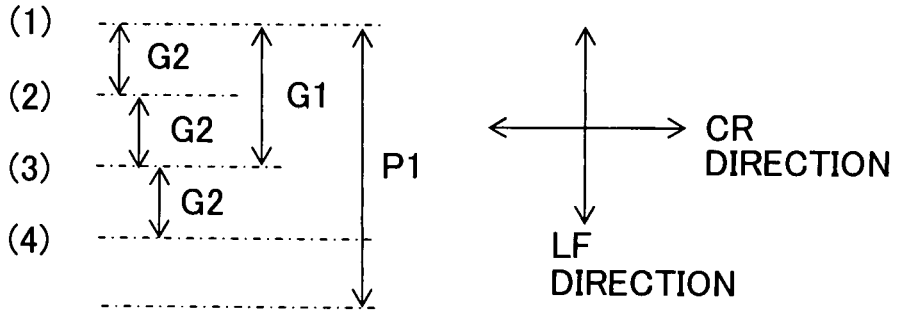
FIG. 4B is a diagram showing positions of forming the nozzles.
Figure 7:
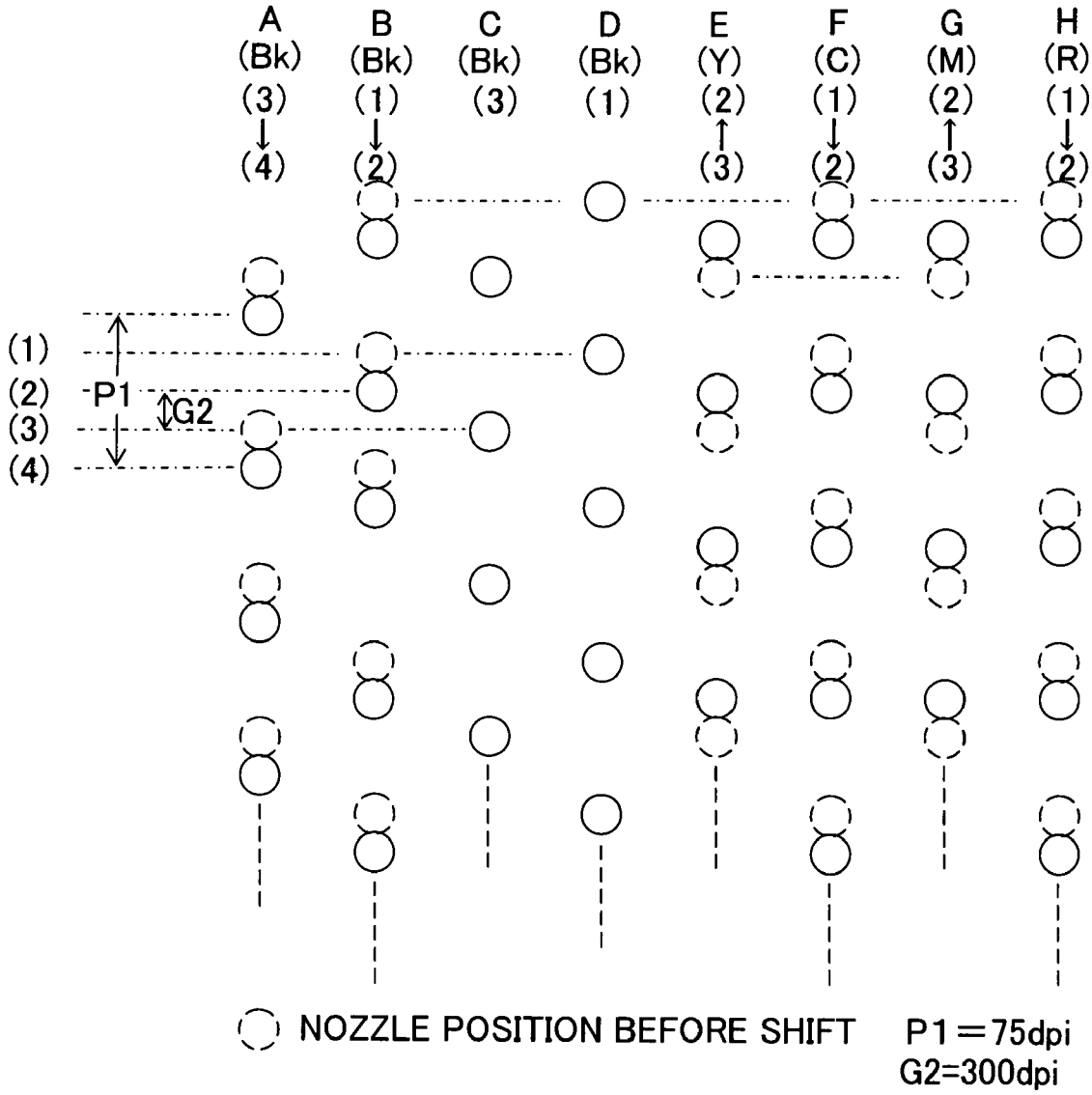
FIG. 7 is a diagram showing an arrangement of nozzles shown in FIG. 6.

As shown in FIG. 7, the nozzles 39*a* in the four nozzle rows for the black ink are at LF positions (LF1, LF2, LF3, and LF4) in FIG. 4B, the nozzles 39*b*, 39*c*, and 39*d* for the other color inks are at the LF position LF2. The pitch of the nozzles is same as the nozzle pitch in the ink-jet head according to the normal specifications mentioned above. FIG. 11B is a table showing shift-positions of the color-image focused specifications and the black high-speed specifications with respect to the normal specifications. According to the specifications of this ink-jet head 30, in a case of the recording by the black ink, the resolution of one pass is 300 dpi, and in a case of the recording by the color ink, the resolution of one pass is 75 dpi.

Figure 8A:
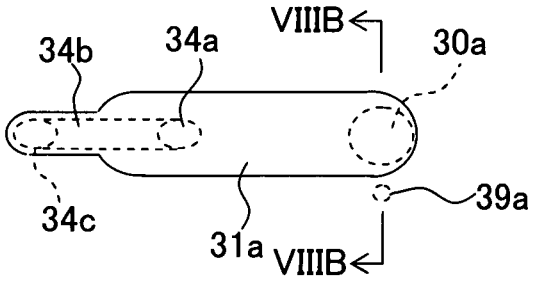
FIG. 8A is an enlarged view of the pressure chamber and the nozzle shown in FIG. 6.
Figure 8B:
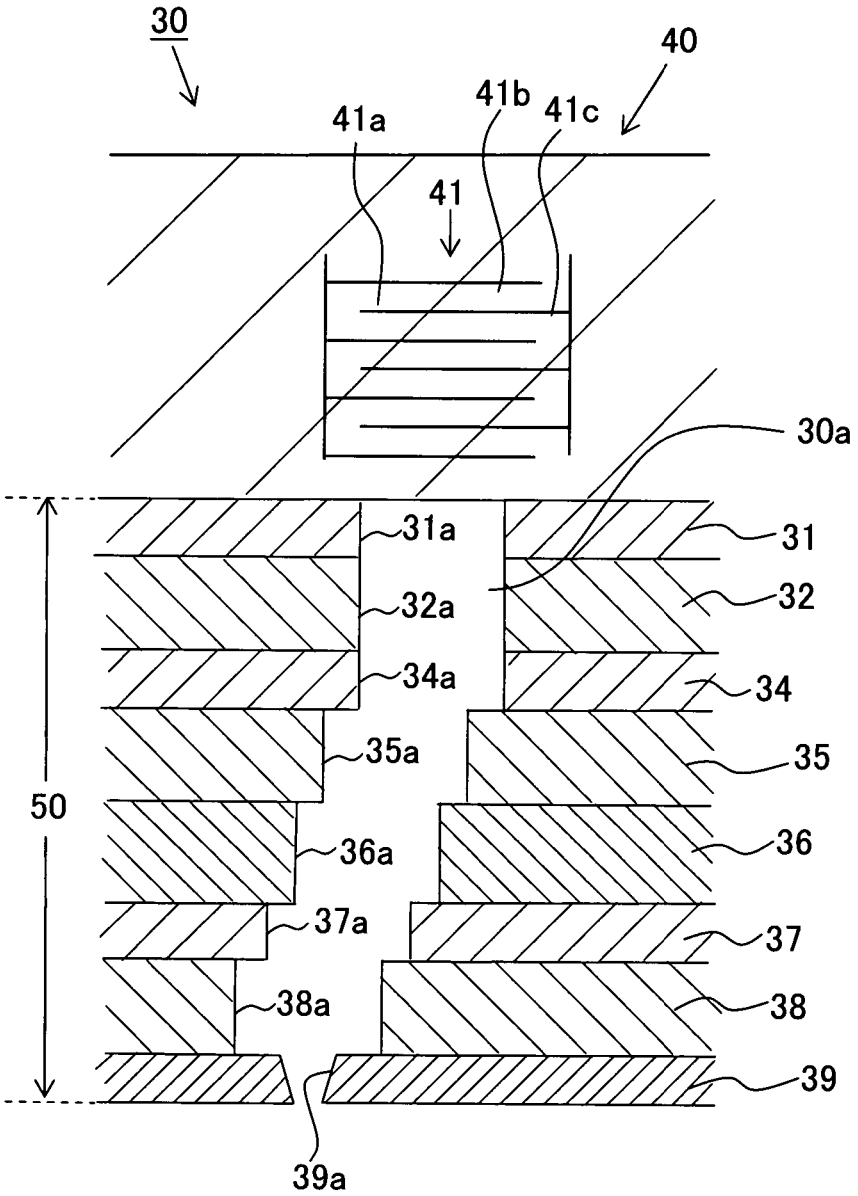
FIG. 8B is a vertical cross-sectional view of a portion from a piezoelectric actuator up to the nozzle, in a portion viewed from a direction of arrow VIIIB-VIIIB in FIG. 8A.

In the following description, an actual paper feeding direction will be called as an LF positive direction, and a direction opposite to the paper feeding direction will be called as an LF negative direction. In FIG. 7, an upward arrow shows a shift in the LFpositive direction, and a downward arrow shows a shift in the LF negative direction. As shown in FIG. 8B, unlike the descender 30*a* formed in the ink-jet head according to the normal specifications (refer to FIG. 5B), the position of the nozzle formed in the nozzle plate 39, which communicates with the descender 30*a* formed in the ink-jet head 30 corresponding to the pressure chamber rows A, B, F, and H, is shifted in the LF negative direction. Moreover, the descender 30*a* formed corresponding to the pressure chamber rows E and G, is shifted in the LF positive direction. The communicating holes 32*a* to 38*a* are formed to be of the same diameter. A cross-section of the descender 30*a* when the position of the nozzle is shifted in the LF positive direction with respect to the normal specifications, and a cross-section shown in FIG. 8B are mutually opposite in the left and right direction. A center of the communicating holes 32*a* formed in the base plate 32 coincides with a center of the communicating hole 34*a* formed in the supply plate 34, and these communicating holes are formed along the vertical direction. In other words, the piezoelectric actuator 40, the cavity plate 31, the base plate 32, and the supply plate 34 which are same as according the normal specifications are used.

Corresponding to the pressure chamber rows A, B, F, and H, the center of the communicating hole 34*a* formed in the supply plate 34, and the center of the communicating hole 35*a* formed in the manifold plate 35 are arranged not to coincide, and the center of the communicating hole 35*a* is shifted in the LF negative direction, from the center of the communicating hole 34*a*. Moreover, the center of the communicating hole 35*a* formed in the manifold plate 35 and the center of the communicating hole 36*a* formed in the manifold plate 36 do not coincide mutually, and the center of the communicating hole 36*a* is shifted in the LF negative direction from the center of the communicating hole 35*a*.

Moreover, the center of the communicating hole 36*a* formed in the manifold plate 36, and the center of the communicating hole 37*a* formed in the damper plate 37 do not coincide, and the center of the communicating hole 37*a* is shifted in the LF negative direction, from the center of the communicating hole 36*a*. Furthermore, the center of the communicating hole 37*a* formed in the damper plate 37 and the center of the communicating hole 38*a* formed in the spacer plate 38 do not coincide, and the center of the communicating hole 38*a* is shifted in the LF negative direction, from the center of the communicating hole 37*a*. The center of the communicating hole 38*a* coincides with the center of the nozzle 39*a*.

In other words, from among the plurality of communicating holes which form the descender 30*a*, each communicating hole from the communicating hole 35*a* formed in the manifold plate 35 to the communicating hole 38*a* formed in the spacer plate 38 is shifted in the LF negative direction by a predetermined amount. Accordingly, the nozzle 39*a* is shifted by P1/4=G2 (=84.7 μm) in the LF negative direction from the nozzle 39*a* according to the normal specifications. In the nozzle rows E and G, the nozzles in these nozzle rows are shifted similarly, to the LF negative direction.

Figure 12A:
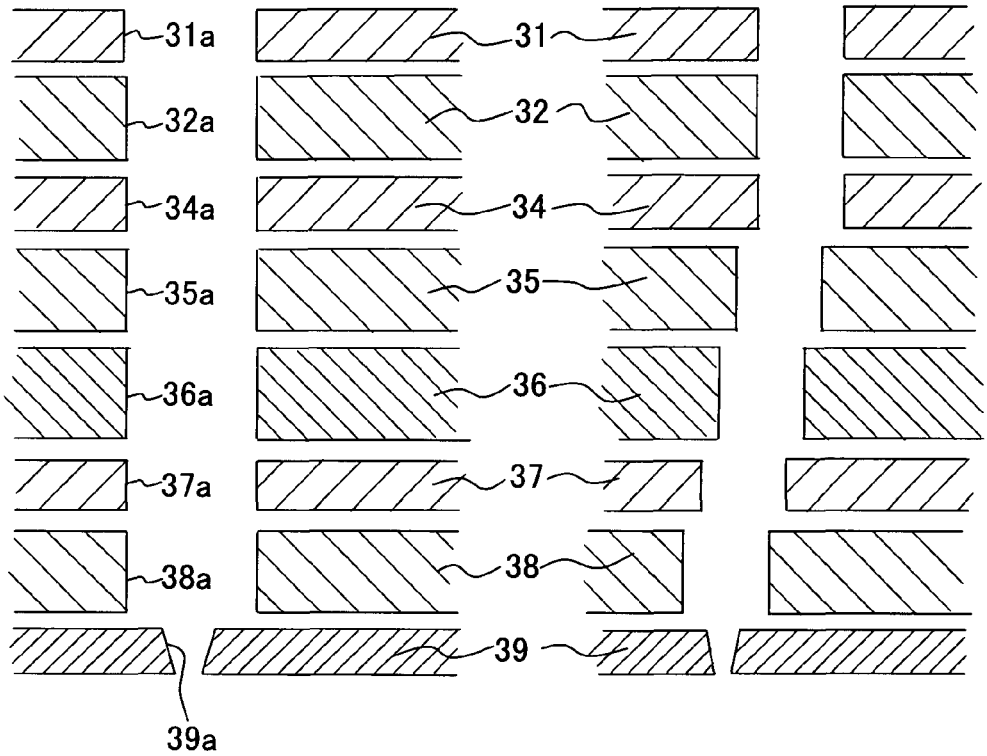
FIG. 12A is a diagram showing a plates-providing step.
Figure 12B:
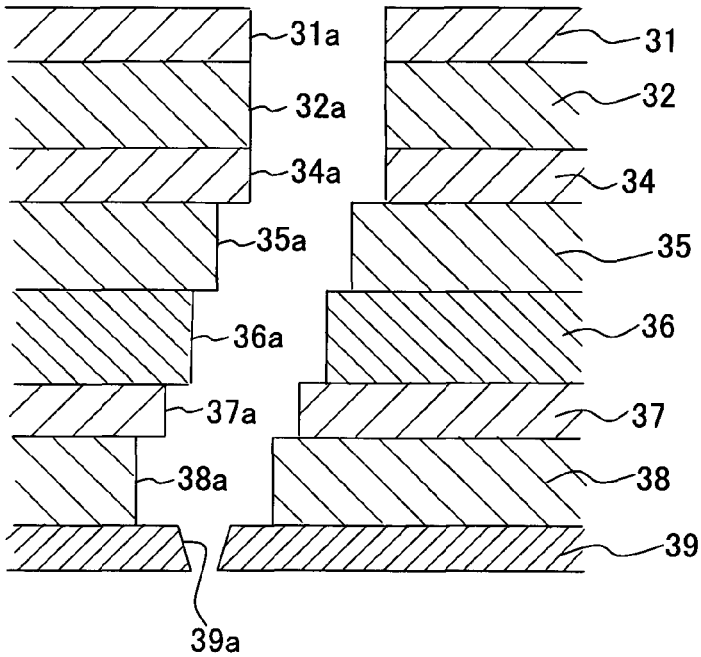
FIG. 12B is a diagram showing a selecting step and a stacking step.

It is possible to manufacture the ink-jet head 30 according to the black high-speed specifications, by providing the cavity plate 31, the base plate 32, the supply plate 34, the manifold plates 35 and 36, the damper plate 37, the spacer plate 38, and the nozzle plate 39 (step of providing the plates, plates-providing step) as shown in FIG. 12A, then selecting plates corresponding to the black high-speed focused specification among the manifold plates 35 and 36, the damper plate 37, the spacer plate 38, and the nozzle plate 39 (selecting step) as shown in FIG. 12B. Specifically, plates in which the position of formation of each of the communicating holes 35*a*, 36*a*, 37*a*, 38*a*, and the nozzle 39*a* is displaced in the LF negative direction or the LF positive direction, from the position of formation according to the normal specifications. Then it is possible to produce the ink-jet head 30 by stacking these plates as shown in FIG. 12B (stacking step). In this case, since it is possible to use the piezoelectric actuator 40, the cavity plate 31, the base plate 32, and the supply plate 34 commonly with the ink-jet head 30 according to the normal specifications, it is not necessary to manufacture the piezoelectric actuator 40, the cavity plate 31, the base plate 32, and the supply plate 34 newly for the black high-speed focused specifications. Consequently, manufacturing only the manifold plates 35 and 36, the damper plate 3.7, the spacer plate 38, and the nozzle plate 39 according to the black high-speed specifications will serve the purpose. An ink-jet head for color-image focused specifications, which will be described later, and the ink-jet head for normal specifications can be produced in the similar steps by selecting appropriate plates corresponding to the specifications in the selecting step.

Next, the arrangement of the pressure chambers and the nozzles in the ink-jet head according to the color-image focused specifications will be described below.

Figure 9:
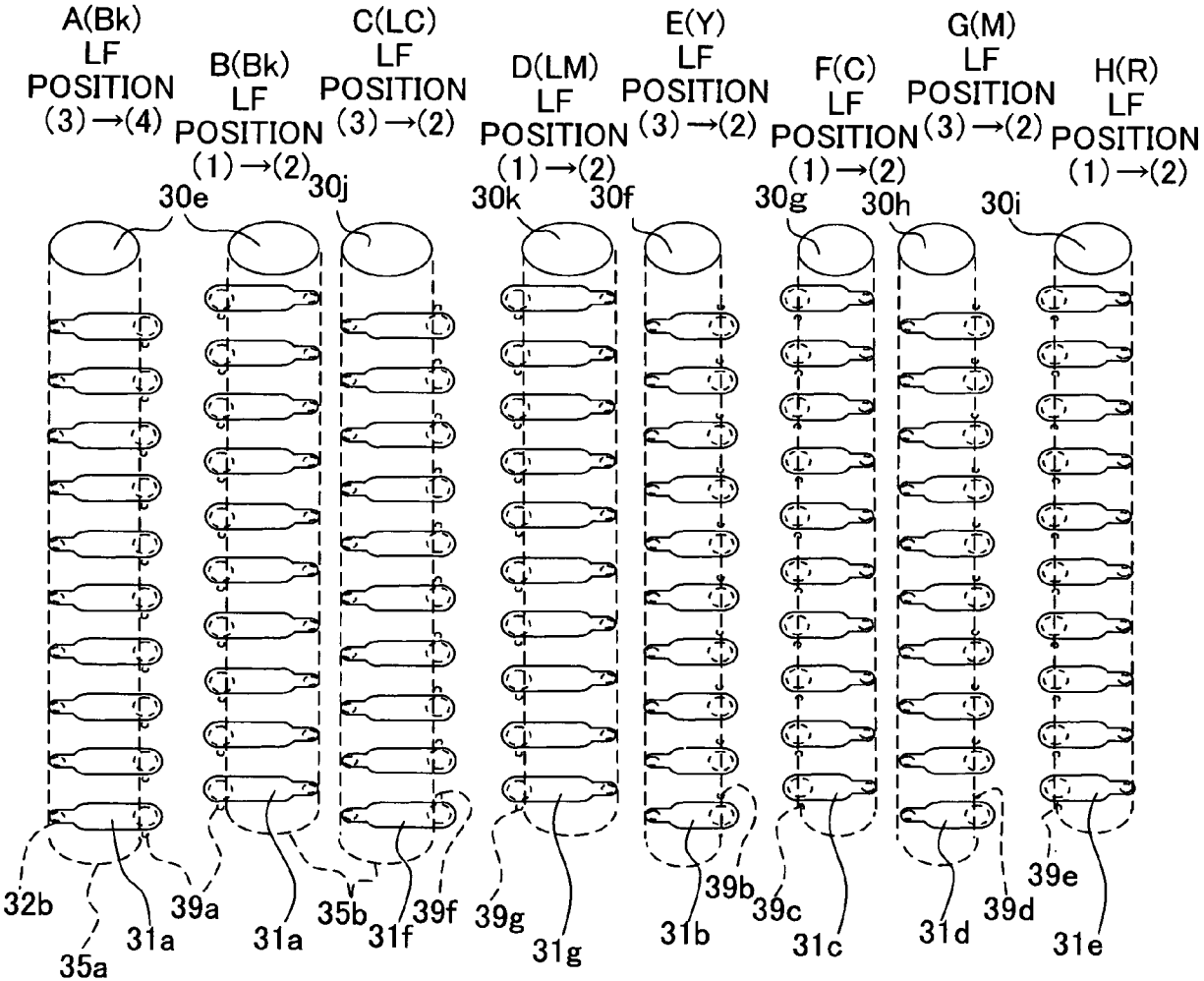
FIG. 9 is a diagram showing an arrangement of pressure chambers and nozzles of an ink-jet head according to the color-image focused specifications.

As shown in FIG. 9, in the ink-jet head 30 according to the color-image focused specifications the pressure chamber rows A and B are used for jetting the pigment-based black ink, the pressure chamber row C is used for jetting the dye-based light cyan ink, the pressure chamber row D is used for jetting the dye-based light magenta ink, the pressure chamber row E is used for jetting the dye-based yellow ink, the pressure chamber row F is used for jetting the dye-based cyan ink, the pressure chamber row G is used for jetting the dye-based magenta ink, and the pressure chamber row H is used for jetting the dye-based red ink. By using the light cyan ink and the light magenta ink in the pressure rows C and D which are capable of discharging an ink droplet of a substantial volume, it is possible to reduce a granular appearance (a granular texture, a rough texture) when a color image is recorded on the recording paper, and to perform image recording with a high image quality. Each of the piezoelectric actuator, a cavity plate 31, a base plate 32, and a supply plate 34 corresponding to the pressure chamber rows A to H is the same as in the case of the normal specifications and the black high-speed focused specifications.

Figure 10:
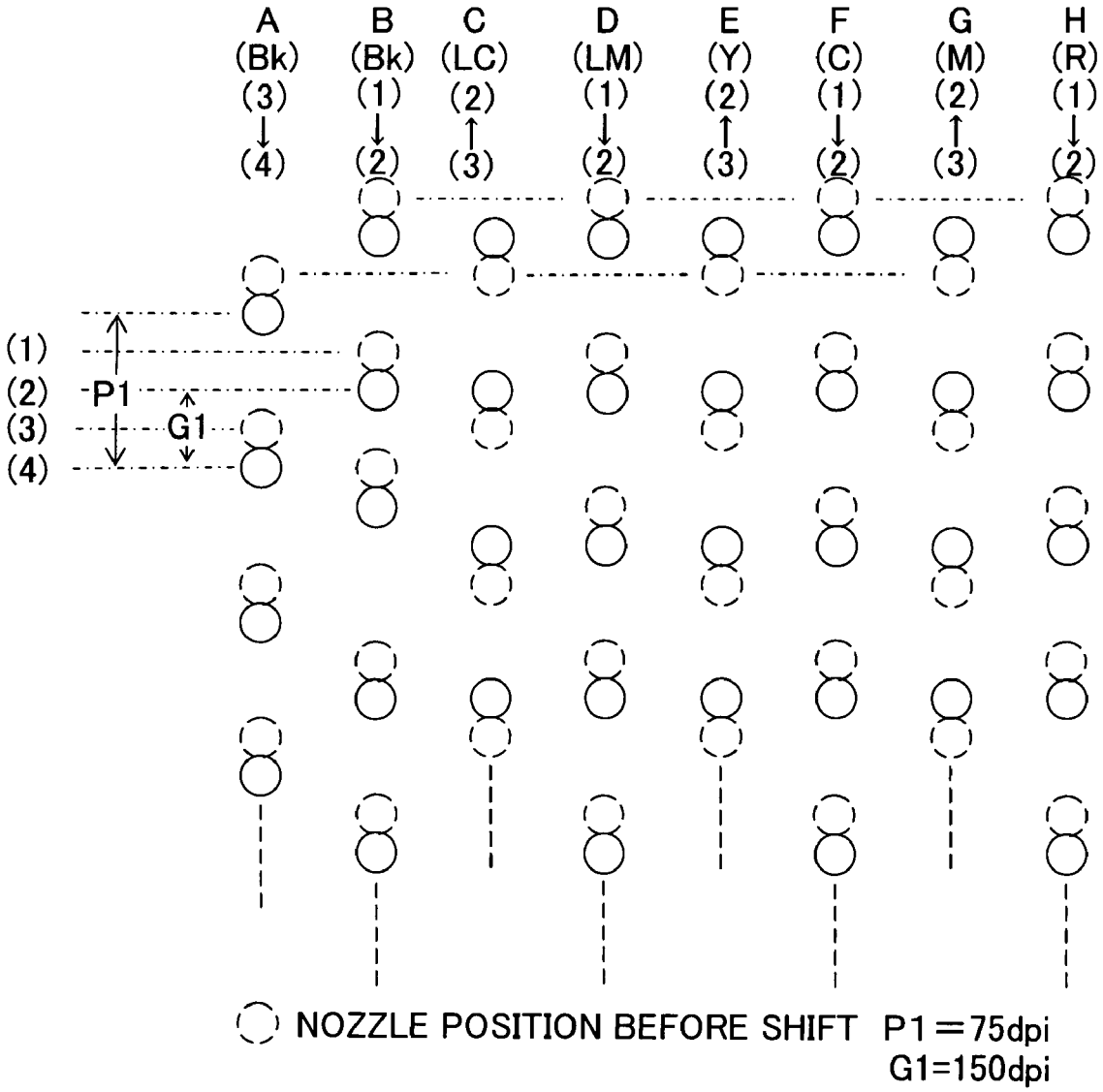
FIG. 10 is a diagram showing an arrangement of nozzles shown in FIG. 9.

As shown in FIG. 10, the nozzles 39*a* in the two nozzle rows for the black ink are at LF positions (LF2 and LF4) in FIG. 4B, and nozzles 39*b*, 39*c*, 39*d*, 39*e*, 39*f*, and 39*g* for the inks of other colors are at the LF2. The nozzle pitch is the same as in the case of the ink-jet head according to the normal specifications mentioned above. According to the specifications of this ink-jet head 30, in a case of the recording by the black ink, the resolution which is available in one-pass driving (one-pass resolution) is 150 dpi, and in a case of the recording by the color ink, the one-pass resolution is 75 dpi.

A structure of the descender 30*a* is same as in the case of the ink-jet head 30 according to the black high-speed focused specifications shown in FIG. 8B. In FIG. 9 and FIG. 10, the structure of the descender 30*a* which communicates with the nozzles in the nozzle rows A, B, D, and F which are displaced in the LF negative direction as compared to a structure according to the normal specifications is same as shown in FIG. 8B, and a cross-sectional view of the nozzle rows C, E, and G, in which the positions of nozzles are shifted in the LF positive direction, has left and right sides opposite to that shown in FIG. 8B. In other words, since it is possible to use the piezoelectric actuator 40, the cavity plate 31, the base plate 32, and the supply plate 34 commonly for the ink-jet head 30 according to the normal specifications and the black high-speed specifications, it is not necessary to manufacture the piezoelectric actuator 40, the cavity plate 31, the base plate 32, and the supply plate 34 newly for the color-image focused specifications. Consequently, manufacturing only the manifold plates 35 and 36, the damper plate 37, the spacer plate 38, and the nozzle plate 39 according to the color-image focused specifications will serve the purpose.

As it has been mentioned above, according to the method of manufacturing the ink-jet recording apparatus 1 described in the embodiment, since it is possible to use the piezoelectric actuator 40, the cavity plate 31, the base plate 32, and the supply plate 34 commonly according the normal specifications, the black high-speed focused specifications, and the color-imaae focused specifications, it is possible to decrease the number of manufacturing lines and reduce the manufacturing cost of the ink-jet recording apparatus. Among the structural components of the ink-jet head 30, in particular, the piezoelectric actuator 40 is expensive. According to the method of manufacturing the ink-jet head in this embodiment, since it is not necessary to manufacture a different piezoelectric actuator for each of the specifications, it is possible to reduce extensively the manufacturing cost of the ink-jet recording apparatus.

Moreover, since the cavity plate 31 is common for all specifications, there is no fear that an error in a stacking position with respect to an intermediate plate of the pressure chamber formed in the cavity plate varies according to each of the specifications. Consequently, there is no fear that the AL value varies for each of the specifications, and that there is an effect on jetting characteristics of a liquid droplet. Furthermore, when the supply plate 34 is manufactured in a different manufacturing line for each of the specifications, a manufacturing error according to each manufacturing line is reflected in the supply plate which is manufactured by each manufacturing line. There is a fear that this manufacturing error appears as a dimensional error for each of the specifications of an aperture 34*b*. However, since it is possible to manufacture the supply plate according to each of the specifications in the same manufacturing line, it is possible to make the dimensional error of the aperture to be the same through each of the specifications. Consequently, it is possible to suppress a variation in liquid droplet jetting characteristics due to a variation in the channel resistance of the aperture.

Only the piezoelectric actuator 40 and the cavity plate 31 may be manufactured commonly according to each of the specifications. Moreover, the piezoelectric actuator 40 and the cavity plate 31 may be manufactured commonly according to each of the specifications, as well as one of the base plate 32 and the supply plate 34 may be manufactured commonly according to each of the specifications. In the embodiment mentioned above, as a liquid droplet jetting head of the present invention, the description has been made by giving an example of an ink-jet recording head. However, the present invention is also applicable to an apparatus which jets a liquid other than ink. Moreover, the present invention is also applicable to a recording apparatus which jets an ink droplet by using a pressure change due to an air bubble developed in the ink, by imparting heat energy to the ink.

Furthermore, in the ink-jet recording apparatus of the embodiment, a structure in which the aperture 34*b* and a communicating hole 34*d* are formed in the supply plate 34 is used. However, a structure may be such that only the aperture 34*b* is formed in the supply plate 34, and the supply plate 34 is sandwiched between the base plate 32 in which the communicating hole 32*b* is formed, and the spacer plate 34 in which the communicating hole 34*d* is formed. Moreover, a structure may be such that the aperture 34*b* is formed in a lower surface of the base plate 32, and the spacer plate in which only the communicating hole 34*d* is formed is arranged under the base plate 32.

In the embodiment described above, the description has been made by giving an example of a piezoelectric actuator in which, a plurality of piezoelectric layers is stacked. However, the piezoelectric actuator is not restricted to the multiple-layered piezoelectric actuator, and may be a single-layered piezoelectric actuator. Moreover, a vibration plate may be arranged between the piezoelectric layer and the cavity unit.

What is claimed is:

1. A liquid droplet jetting head which jets a droplet of a liquid, comprising:

a cavity unit including:

a plurality of nozzles arranged in a predetermined surface;

a plurality of pressure chambers which accommodate the liquid; and a plurality of liquid channels which connect the nozzles and the pressure chambers respectively, and which have portions extending in a vertical direction to the predetermined surface and other portions extending in a direction different from the vertical direction such that the center portion of a liquid channel nearest a pressure chamber does not coincide with the center portion of a liquid channel nearest the nozzle; and an actuator which is arranged on the cavity unit and which selectively applies a jetting pressure to the liquid in the pressure chambers.

2. The liquid droplet jetting head according to claim 1;

wherein the liquid channels include a first liquid channel extended in a first direction different from the vertical direction, and a second liquid channel extended in a second direction different from the vertical direction and the first direction.

3. The liquid droplet jetting head according to claim 1;

wherein the cavity unit includes a first pressure chamber row and a second pressure chamber row arranged to be parallel to each other;

wherein each of the first pressure chamber, row and the second pressure chamber row includes a plurality of pressure chambers having an elongated shape, and which are arranged in a predetermined direction; and wherein a length of a pressure chamber included in the first pressure chamber row, in a longitudinal direction of the pressure chamber is greater than a length of another pressure chamber included in the second pressure chamber row, in the longitudinal direction of the pressure chamber.

4. The liquid droplet jetting head according to claim 3;

wherein a size of a nozzle, among the nozzles, connected to the pressure chamber in the first pressure chamber row is greater than a size of another nozzle connected to the pressure chamber in the second pressure chamber row.

5. A method for manufacturing liquid droplet jetting heads which have a plurality of specifications, and each of which includes a cavity unit having a plurality of nozzles which jet a droplet of a liquid, a plurality of pressure chambers which accommodate the liquid, and a plurality of liquid channels which connect the nozzles and the pressure chambers respectively, and an actuator which selectively applies a jetting pressure to the liquid in the pressure chambers, the method comprising steps of:

a plates-providing step for providing a nozzle-plate group which includes:

a plurality of nozzle plates in which the nozzles are formed in different patterns;

an intermediate-plate group which includes a plurality of intermediate plates in which the liquid channels are formed in a different pattern respectively; and a cavity plate in which the pressure chambers are formed;

a selecting step for selecting a nozzle plate among the nozzle-plate group which corresponds to a predetermined specification among the specifications and an intermediate plate among the intermediate-plate group which corresponds to the predetermined specification; and a stacking step for stacking the nozzle plate and the intermediate plate selected in the selecting step, and the cavity plate, wherein the plurality of liquid channels which connect the nozzles and the pressure chambers respectively have portions extending in a vertical direction to the predetermined surface and other portions extending in a direction different from the vertical direction such that the center portion of a liquid channel nearest a pressure chamber does not coincide with the center portion of a liquid channel nearest the nozzle.

6. The method for manufacturing the liquid droplet jetting head according to claim 5;

wherein the intermediate plates include a manifold plate in which the liquid channels and a common liquid chamber accommodating the liquid to be supplied to the pressure chambers are formed;

wherein the plates-providing step further includes providing a supply plate in which a plurality of throttles is formed, the throttles supplying the liquid from the common liquid chamber to the pressure chambers, having a channel resistance higher than a channel resistance of the pressure chambers, and connecting the common liquid chamber with the pressure chambers, when the supply plate is stacked into the cavity unit;

wherein the cavity plate and the supply plate are commonly used for the specifications; and wherein the stacking step further includes stacking the supply plate.

7. The method for producing the liquid droplet jetting head according to claim 6;

wherein the throttles are formed as grooves in the supply plate;

wherein the plates-providing step further includes providing a base plate which is common in the specifications and which has communicating holes formed therein, the common holes connecting the pressure chambers with the throttles respectively when the base plate is stacked between the cavity plate and the supply plate; and wherein the stacking step further includes stacking the base plate on the supply plate to cover openings of the throttles.

8. The method for manufacturing the liquid droplet jetting head according to claim 5;

wherein the liquid channels, which are to be mutually communicated when the intermediate plates are stacked, are formed in the intermediate plates; and wherein the stacking step further includes stacking each of the intermediate plates between the cavity plate and one of the nozzle plates such that the liquid channels are mutually communicated to thereby connect the pressure chambers and the nozzles respectively.

9. The method for providing the liquid droplet jetting head according to claim 8;

wherein the intermediate plates include a manifold plate in which the liquid channels and the common liquid chamber which accommodates the liquid to be supplied to the pressure chambers are formed.

10. The method for manufacturing the liquid droplet jetting head according to claim 8;

wherein the intermediate plates include a manifold plate in which a common liquid chamber accommodating the liquid to be supplied to the pressure chambers is formed; and a damper plate which is to be stacked on the manifold plate and in which the liquid channels and a damper elastically deformable by a pressure vibration in the common liquid chamber are formed; and wherein the stacking step further includes stacking the damper plate between the manifold plate and one of the nozzle plates such that the damper faces the common liquid chamber.

11. The method for manufacturing the liquid droplet jetting head according to claim 8;

wherein the intermediate plates include a spacer plate in which the liquid channels are formed; and wherein the stacking step further includes stacking the spacer plate such that the spacer plate is adjacent to a surface, of one of the nozzle plates, on a side of the cavity plate.

12. The method for manufacturing the liquid droplet jetting head according to claim 5;

wherein the liquid is an ink, and the liquid droplet jetting head is an ink-jet head which performs printing in a dot matrix manner by the ink jetted from the nozzles while moving in a predetermined direction with respect to the recording medium;

wherein the pressure chambers are arranged in a matrix form, in the cavity plate in the predetermined direction and in an orthogonal direction orthogonal to the predetermined direction;

wherein the nozzles connecting to the pressure chambers respectively are arranged in the matrix form, in each of the nozzle plates in the predetermined direction and in the orthogonal direction;

wherein the liquid channels are arranged in the matrix form, in each of the intermediate plates in the predetermined direction and in the orthogonal direction;

wherein the plates-providing step includes providing the nozzle plates in which positions of the nozzles in the orthogonal direction are mutually different and the intermediate plates in which positions of the liquid channels are mutually different;

wherein the selecting step includes selecting one of the nozzle plates in which the nozzles are formed at positions corresponding to one of the specifications and one of the intermediate plates in which the liquid channels are formed at positions corresponding to the positions of the nozzles; and wherein the stacking step includes stacking the selected nozzle plate and intermediate plate.

13. The method for manufacturing the liquid droplet jetting head according to claim 12;

wherein the pressure chambers forms a first pressure chamber group jetting a first liquid droplet and a second pressure chamber group jetting a second liquid droplet having a volume greater than a volume of the first liquid droplet, the first and second pressure chamber groups being arranged in the predetermined direction; and wherein the specifications include a specification in which the first pressure chamber group accommodates a color ink, and the second pressure chamber group accommodates a black ink.

14. The method for manufacturing the liquid droplet jetting head according to claim 13;

wherein the specifications includes another specification in which a pressure chamber included in the second pressure chamber group accommodates the color ink.

* * * * *